US007121651B2

(12) United States Patent
Takahashi et al.

(10) Patent No.: US 7,121,651 B2
(45) Date of Patent: Oct. 17, 2006

(54) DROPLET-JETTING DEVICE WITH PRESSURE CHAMBER EXPANDABLE BY ELONGATION OF PRESSURE-GENERATING SECTION

(75) Inventors: Yoshikazu Takahashi, Nagoya (JP); Hiroyuki Ishikawa, Nissin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/434,792

(22) Filed: May 8, 2003

(65) Prior Publication Data

US 2003/0210306 A1 Nov. 13, 2003

(30) Foreign Application Priority Data

May 9, 2002 (JP) ..... 2002-133596
May 10, 2002 (JP) ..... 2002-136166

(51) Int. Cl.
*B41J 2/045* (2006.01)
*B41J 2/04* (2006.01)

(52) U.S. Cl. ..... 347/71; 347/54

(58) Field of Classification Search ..... 347/70–72, 347/54

See application file for complete search history.

(56) References Cited

U.S. PATENT DOCUMENTS 4,364,070 A 12/1982 Matsuda et al.
5,943,079 A 8/1999 Yoshida
6,072,509 A 6/2000 Wen et al.
6,139,132 A * 10/2000 Yasukawa et al. ..... 347/70
6,174,051 B1 1/2001 Sakaida
6,176,571 B1 * 1/2001 Kishima et al. ..... 347/70
6,297,577 B1 10/2001 Hotomi et al.

FOREIGN PATENT DOCUMENTS

| | | |
|---|---|---|
| DE | 29 05 063 | 8/1980 |
| DE | 196 39 717 | 4/1997 |
| EP | 0 573 055 A2 | 12/1993 |
| JP | 61-083045 | 4/1986 |
| JP | 61-089856 | 5/1986 |
| JP | 0 956 955 A2 | 11/1999 |
| WO | WO 00/16981 | 3/2000 |

* cited by examiner

*Primary Examiner*—Stephen Meier
*Assistant Examiner*—Julian D. Huffman
(74) *Attorney, Agent, or Firm*—Reed Smith LLP

(57) ABSTRACT

A droplet-jetting device, which is usable for an ink-jet recording apparatus, comprises a pressure chamber disposed between a cavity plate and a pressure-generating section of a piezoelectric actuator. The pressure-generating section and the cavity plate are connected by a connecting section. When a voltage is applied to the piezoelectric actuator, the pressure-generating section is elongated to depress the bottom of the pressure chamber downwardly so that the volume of the pressure chamber is increased. The droplet-jetting device is realized, in which the area of arrangement of the pressure-generating section is decreased to suppress the electrostatic capacity and the pull-eject can be performed by applying the voltage only when the device is driven.

13 Claims, 26 Drawing Sheets

DROPLET-JETTING DEVICE WITH PRESSURE CHAMBER EXPANDABLE BY ELONGATION OF PRESSURE-GENERATING SECTION

BACKGROUND OF THE INVENTION

1. Field of the Invention

The present invention relates to a droplet-jetting device such as an ink-jet head of an ink-jet printer.

2. Description of the Related Art

An apparatus has been hitherto suggested, in which a piezoelectric droplet-jetting device is utilized for a print head. This device is constructed such that the volume of a liquid chamber is changed by the dimensional displacement of a piezoelectric actuator, and thus the liquid (ink) contained in the liquid chamber is jetted from a nozzle during the decrease of the volume, while the ink is introduced into the liquid chamber during the increase of the volume. A large number of the droplet-jetting devices as described above are arranged closely to one another, and the ink is jetted from the droplet-jetting device disposed at a predetermined position. Accordingly, a desired letter or an image is formed.

For example, FIG. 28 shows an ink-jet print head which utilizes the conventional piezoelectric droplet-jetting device. FIG. 28 shows a magnified sectional view illustrating the conventional piezoelectric ink-jet head. The piezoelectric ink-jet head comprises nozzles 215 which are open to the outside, pressure chambers 216 which supply the ink to the nozzles 215, a common ink chamber 212*a* which distributes the ink from an unillustrated ink supply source to the plurality of pressure chambers 216 via ink supply holes 218, 216*b* and throttle sections 216*d*, and a piezoelectric actuator 220 provided with pressure-generating sections 228 which apply the pressure to jet the ink to the pressure chambers 216.

The pressure-generating section 228 is a portion of the piezoelectric actuator 220 at which a piezoelectric sheet 222 of the piezoelectric actuator 220 is interposed between a driving electrode 224 and a common electrode 225. The pressure-generating section 228 is subjected to the polarization treatment in a direction directed from the driving electrode 224 to the common electrode 225. When an electric field, which matches the direction in which the polarization treatment is applied, is applied between the driving electrode 224 and the common electrode 225, the pressure-generating section 228 causes the elongation displacement in the thickness direction of the piezoelectric actuator 220. As a result of the displacement, the volume of the pressure chamber 216 is decreased, and the ink contained in the pressure chamber 216 is extruded. Accordingly, ink droplets are jetted from the nozzle 215 which is communicated with the pressure chamber 216.

In order to jet the ink droplets having necessary jetting velocities and volumes more efficiently, i.e., at a lower voltage, the pressure-generating section 228 has been arranged in a region approximately ranging over the entire pressure chamber 216.

However, the conventional piezoelectric ink-jet print head as described above has involved the following problems, because the pressure-generating section has been arranged in the region approximately ranging over the entire pressure chamber. That is, the electrostatic capacity, which is proportional to the area of the pressure-generating section, is increased. The energy efficiency is unsatisfactory. The power source system, which is used to drive the ink-jet print head, suffers from the increase in cost.

The piezoelectric ink-jet print head as described above is suitable for the so-called "push-eject" in which the ink droplets are jetted by decreasing the volume of the pressure chamber when the driving voltage is applied. However, when such a method is used, a problem arises such that the supply of the ink is not performed in time, and it is impossible to increase the driving frequency so much. Further, when such a method is used, a problem arises such that the volume of the ink droplet cannot be increased so much as well.

Therefore, it is intended to perform the so-called "pull-eject" as a method for increasing the driving frequency and increasing the volume of the droplet, in which the volume of the pressure chamber is firstly increased, and then the volume of the pressure chamber is restored to the original volume at the timing at which the pressure in the pressure chamber is changed from the negative to the positive. In this case, it is necessary to use such a method that the volume of the pressure chamber is always decreased by always applying a voltage, and the voltage application is shut off only when the printing operation is performed. Therefore, the energy efficiency has been extremely unsatisfactory.

In such a method, it is also conceived that a reverse electric field is applied in order to increase the volume of the ink chamber. However, if such a procedure is adopted, only a low electric field, which causes no polarization reversal, can be applied. It is impossible to jet any sufficient amount of ink droplets.

SUMMARY OF THE INVENTION

The present invention has been made in order to solve the problems as described above, a first object of which is to provide a droplet-jetting device in which the electrostatic capacity is suppressed to improve the energy efficiency and the voltage is applied only when the device is driven so that the pull-eject is successfully performed, and an ink-jet recording apparatus provided with the same. A second object of the present invention is to provide a droplet-jetting device which makes it possible to increase the driving frequency and which makes it possible to increase the volume of the liquid droplet, and an ink-jet recording apparatus provided with the same.

According to the present invention there is provided a droplet-jetting device comprising a nozzle which jets a liquid, a pressure chamber which supplies the liquid to the nozzle, and a pressure-generating section which applies a pressure to the pressure chamber in order to jet the liquid from the nozzle; wherein a wall surface, which defines the pressure chamber, is displaceable to vary a volume of the pressure chamber; and the droplet-jetting device further comprises a connecting section which connects the pressure-generating section to the wall surface to transmit displacement of the pressure-generating section to the wall surface.

In the droplet-jetting device of the present invention, the displacement of the pressure-generating section is transmitted via the connecting section to the wall surface of the pressure chamber disposed opposingly thereto. Accordingly, even when the amount of displacement volume of the pressure-generating section is small, it is possible to obtain a large volume change of the pressure chamber. Therefore, even when the pressure-generating section is moved such that a part of the volume of the pressure chamber is replaced therewith during the driving, it is possible to expand the volume of the entire pressure chamber. The pressure-generating section is thereafter restored, and thus the volume is restored to the original volume. Accordingly, it is possible to perform the pull-eject. When the connecting section is provided, it is possible to expand the pressure chamber when the pressure-generating section is elongated toward the pressure chamber. Accordingly, it is possible to realize the pull-eject in which the volume change is large.

In the droplet-ejection device of the present invention, when the pressure-generating section is displaced, while the displacement of the connecting section does not directly change the volume of the pressure chamber, the wall surface may increase the volume of the pressure chamber.

The droplet-jetting device of the present invention may further comprise an actuator unit which covers a surface opposed to the wall surface of the pressure chamber and which includes the pressure-generating section, wherein the pressure-generating section may effect the displacement in an area which is smaller than the surface of the pressure chamber opposed to the wall surface. In the droplet-jetting device of this arrangement, the displacement of the pressure-generating section, which is caused in the small area, is transmitted to the wall surface of the pressure chamber which is wider than the above. Therefore, it is possible to obtain the desired change of the volume of the pressure chamber by using the energy smaller than that used in the conventional technique.

The droplet-jetting device of the present invention may be structured such that the wall surface of the pressure chamber has one end which is disposed in a longitudinal direction of the pressure chamber and which serves as a support point, and the other end which is displaceable about the support point in the direction to vary the volume of the pressure chamber. In this structure, the other end of the pressure chamber is depressed downwardly by using the support point of one end of the pressure chamber in the longitudinal direction. Therefore, it is possible to increase the volumetric displacement of the pressure chamber. In this arrangement, an area of the actuator unit to be displaced by the pressure-generating section may be about 5% to 40% with respect to an area of the surface of the pressure chamber. When this areal ratio is adopted, it is possible to more greatly expand the volume of the pressure chamber more easily by means of the areal displacement of the pressure-generating section.

In the droplet-jetting device of the present invention, the pressure chamber may have one end which is disposed in a longitudinal direction and which is communicated with the nozzle, and the other end which is communicated with an ink supply source via a throttle section having a cross section smaller than that of the pressure chamber, and the connecting section may be composed of a wall portion which comparts the throttle section. In this arrangement, the connecting section is constructed by the wall portion for forming the throttle section which is necessary to increase the flow passage resistance. Therefore, the droplet-jetting device can be produced without increasing the number of parts and without complicating the production steps.

In the droplet-jetting device of the present invention, the pressure chamber may be composed of a plurality of chambers which are arranged in array, a common liquid chamber may be provided to distribute the liquid to the respective chambers, the common liquid chamber may extend in a direction of the array of the respective chambers on a side opposite to the respective chambers with wall sections for constituting the wall surfaces of the respective chambers intervening therebetween, and each of the wall sections for constituting the wall surfaces may be displaced toward the common liquid chamber by the displacement of the pressure-generating section. In this arrangement, the common liquid chamber is adjacent to the respective chambers. Accordingly, each of the chambers is expanded toward the common liquid chamber in accordance with the displacement of the wall surface. Therefore, it is possible to realize the displacement of the wall surface of each of the chambers without preparing any special space.

The droplet-jetting device of the present invention may further comprise a first plate which has a first opening corresponding to the pressure chamber formed penetratingly in a plate thickness direction, a second plate which has a second opening corresponding to the common liquid chamber formed penetratingly in the plate thickness direction, and a third plate which has the wall section disposed between the pressure chamber and the common liquid chamber, wherein the third plate may be positioned between the first and second plates. When the common liquid chamber and the pressure chamber have the stacked structure as described above, it is possible to easily realize the droplet-jetting device of the present invention.

In the droplet-jetting device of the present invention, the pressure-generating section may include a piezoelectric material and electrodes which are positioned opposingly in a direction of polarization thereof, and the piezoelectric material may be elongated by application of a voltage to the electrodes. In this arrangement, the piezoelectric material is elongated by the application of the voltage so that piezoelectric material enters the pressure chamber. However, it is possible to obtain the desired change of the volume of the pressure chamber by using the pressure-generating section having the area smaller than that used in the conventional technique as described above. It is possible to suppress the applied voltage as compared with the conventional technique, and it is possible to decrease the electrostatic capacity.

In the droplet-jetting device of the present invention, when the pressure-generating section is displaced, a volumetric change of the pressure chamber by displacement of the wall surface is greater than a volumetric change of the pressure chamber by displacement of the connecting section.

The droplet-jetting device of the present invention may further comprise a vibration plate which is disposed between the pressure chamber and the pressure-generating section, the vibration plate including a first portion which serves as the connecting section and a second portion which serves as the wall surface, the first portion and the second portion being displaceable in cooperation with each other with a support point section intervening therebetween, the pressure-generating section being arranged opposingly to the first portion, and the second portion being arranged opposingly to the pressure chamber; wherein the first portion may be displaced by the pressure applied by the pressure-generating section, and thus the second portion, which is disposed on a side opposite to the first portion with the support point section intervening therebetween, may be displaced to cause a large volumetric change to the pressure chamber than caused by the first portion. In this droplet-jetting device, when the pressure is applied to the first portion from the pressure-generating section to displace the first portion, the second portion is displaced toward the side opposite to the first portion more greatly than the first portion. Accordingly, even when the pressure-generating section for applying the pressure to the first portion has a small area, i.e., even when the energy is small, it is possible to cause the large volumetric change to the pressure chamber by displacement of the second portion.

In the droplet-jetting device of the present invention, the first portion and the second portion may be aligned and positioned in a longitudinal direction of the pressure chamber, and the second portion may be longer than the first portion in the longitudinal direction. In this arrangement, when the first portion is displaced by applying the pressure to the first portion, the second portion is displaced toward the side opposite to the first portion more greatly than the first portion in accordance with the lever principle, because the second portion is longer than the first portion in the longitudinal direction. Accordingly, it is possible to cause the large volumetric change to the pressure chamber by displacement of the second portion even when the pressure-generating section for applying the pressure to the first portion has the small area.

In the droplet-jetting device of the present invention, the pressure-generating section may include a piezoelectric material and electrodes which are positioned opposingly in a direction of polarization thereof, and the piezoelectric material may be elongated by application of a voltage to the electrodes. The second portion may be displaced to expand the pressure chamber in a direction opposite to the displacement of the first portion brought about by the elongation of the piezoelectric material. In this arrangement, when the voltage is applied to the electrodes of the pressure-generating section, then the piezoelectric material is elongated to displace the first portion, and the support point section serves as a lever so that the second portion is displaced toward the side opposite to the first portion to expand the pressure chamber. Therefore, the pressure chamber is greatly expanded in accordance with the lever principle even when the area of the pressure-generating section is small. Accordingly, it is possible to decrease the electrostatic capacity of the pressure-generating section, and it is possible to suppress the voltage to be low. Further, when the voltage is applied, the second portion is displaced to expand the pressure chamber. Therefore, it is possible to perform the pull-eject by applying the voltage during the jetting. It is possible to reduce the cost of the power source system as compared with a method in which the voltage is always applied while the voltage is shut off during the jetting.

The droplet-jetting device of the present invention may further comprise an actuator unit which covers the entire pressure chamber and which includes the pressure-generating section, wherein the pressure-generating section may be positioned opposingly to the first portion of the vibration plate, the vibration plate may abut against the pressure-generating section at the first portion, and a space may be formed between the second portion and the actuator unit. In this arrangement, when the voltage is applied to the electrodes of the pressure-generating section, then the first portion of the vibration plate opposed to the pressure-generating section is displaced, and the second portion is displaced about the support point section toward the space provided between the second portion and the actuator unit. Thus, it is possible to expand the volume of the pressure chamber.

In the droplet-jetting device of the present invention, the pressure chamber may include a plurality of chambers, the actuator unit and the vibration plate may extend to span the plurality of chambers, and the pressure-generating section may include a plurality of generating sections which are provided for the actuator unit corresponding to the plurality of chambers. In this arrangement, one actuator unit and one vibration plate are used to span the plurality of nozzles and the plurality of chambers. Therefore, a large number of jetting mechanisms can be accumulated to enhance the resolution.

In the droplet-jetting device of the present invention, the vibration plate may have a projection which abuts against the actuator unit between the first portion and the second portion, and the vibration plate may be displaced by using those disposed in the vicinity of the projection as the support point section. In this arrangement, the projection is formed on the vibration plate. Accordingly, the support point, about which the vibration plate makes the motion like a lever, can be formed with ease without requiring any special member.

In the droplet-jetting device of the present invention, the first portion of the vibration plate may be positioned outside the pressure chamber, and the vibration plate may be displaced by using, as the support point, those disposed in the vicinity of a portion of the vibration plate to make abutment against an outer wall of the pressure chamber between the first portion and the second portion. In this arrangement, the first portion is not displaced into the pressure chamber, but the entire pressure chamber is deformed in an identical direction by means of the second portion. Therefore, the volume of the pressure chamber is not decreased, and it is possible to efficiently expand the volume of the pressure chamber.

In the droplet-jetting device of the present invention, owing to the provision of the connecting section, an area of the pressure-generating section can be made smaller than about 60% of an area of the wall surface of the pressure chamber. Accordingly, it is possible to suppress the electrostatic capacity, and it is possible to improve the energy efficiency.

According to another aspect of the present invention, there is provided an ink-jet recording apparatus comprising the droplet-jetting device of the present invention. The ink-jet recording apparatus makes it possible to perform the recording at a high speed and a high resolution, because the ink-jet recording apparatus is provided with the droplet-jetting device of the present invention.

DESCRIPTION OF THE PREFERRED EMBODIMENTS

Specified embodiments of the present invention will be explained with reference to the drawings. However, the present invention is not limited thereto.

First Embodiment

Figure 1:
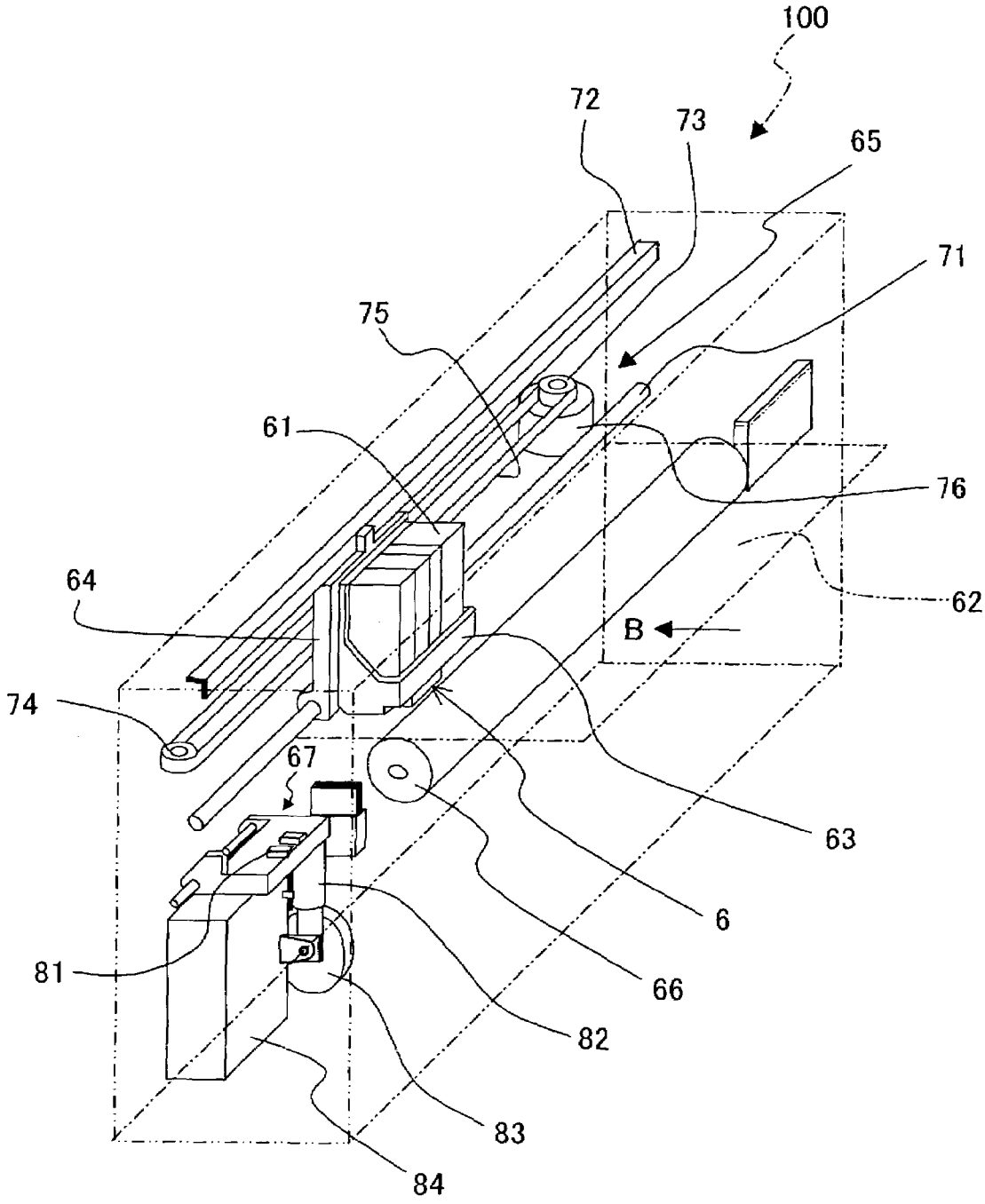
FIG. 1 shows a perspective view illustrating a schematic structure of an ink-jet printer 100 which carries a piezoelectric ink-jet head 6 according to an embodiment of the present invention.

An explanation will be made below on the basis of the accompanying drawings about an embodiment in which the droplet-jetting device of the present invention is applied to an ink-jet head. FIG. 1 shows a perspective view illustrating a schematic structure of a color ink-jet printer which carries the ink-jet head of the present invention. As shown in FIG. 1, the ink-jet printer 100 comprises ink cartridges 61 which are filled with four color inks of, for example, cyan, magenta, yellow, and black, a head unit 63 which is provided with piezoelectric ink-jet heads 6 for performing the printing on printing paper 62 to be fed in the direction of the arrow B in FIG. 1, a carriage 64 on which the ink cartridges 61 and the head unit 63 are carried, a drive unit 65 which allows the carriage 64 to make reciprocating movement in a direction perpendicular to the feeding direction of the printing paper 62, a platen roller 66 which extends in the direction of the reciprocating movement of the carriage 64 and which is arranged opposingly to the piezoelectric ink-jet heads 6, and a purge device 67.

The drive unit 65 includes a carriage shaft 71 which is arranged at the lower end of the carriage 64 and which extends in parallel to the platen roller 66, a guide plate 72 which is arranged at the upper end of the carriage 64 and which extends in parallel to the carriage shaft 71, two pulleys 73, 74 which are disposed between the carriage shaft 71 and the guide plate 72 and which are arranged at the both ends of the carriage shaft 71, and an endless belt 75 which is stretched between the pulleys 73, 74. When one pulley 73 is rotated clockwise/counterclockwise in accordance with the driving of a motor 76, the carriage 64, which is joined to the endless belt 75, is allowed to make reciprocating movement in the linear direction along the carriage shaft 71 and the guide plate 72 in accordance with the clockwise/counterclockwise rotation of the pulley 73.

The printing paper 62 is fed from an unillustrated paper feed cassette which is provided on the side of the color ink-jet printer 100. The printing paper 62 is introduced into the space between the piezoelectric ink-jet heads 6 and the platen roller 66, and the predetermined printing operation is performed thereon with the inks discharged from the piezoelectric ink-jet heads 6. After that, the printing paper 62 is discharged. A paper feed mechanism and a paper discharge mechanism for the printing paper 62 are omitted from the illustration in FIG. 1.

The purge device 67 is provided on the side of the platen roller 66. The purge device 67 is arranged so that the purge device 67 is opposed to the piezoelectric ink-jet heads 6 when the head unit 63 is disposed at the reset position. The purge device 67 includes a cap 81 which makes abutment against an opening surface so that a plurality of nozzles 15 of the piezoelectric ink-jet head 6 are covered therewith as described later on, a pump 82, a cam 83, and an ink storage section 84. When the head unit 63 is disposed at the reset position, the nozzles 15 of the piezoelectric ink-jet head 6 are covered with the cap 81. Any defective ink containing bubbles or the like remaining in the piezoelectric ink-jet head 6 is aspirated by the pump 82 in accordance with the driving of the cam 83 in order to restore the piezoelectric ink-jet head 6 thereby. Accordingly, it is possible to avoid, for example, any discharge failure caused, for example, by the growth of bubbles and the residence of the ink which would possibly occur during the initial introduction of the ink. The aspirated defective ink is stored in the ink storage section 84.

Figure 2:
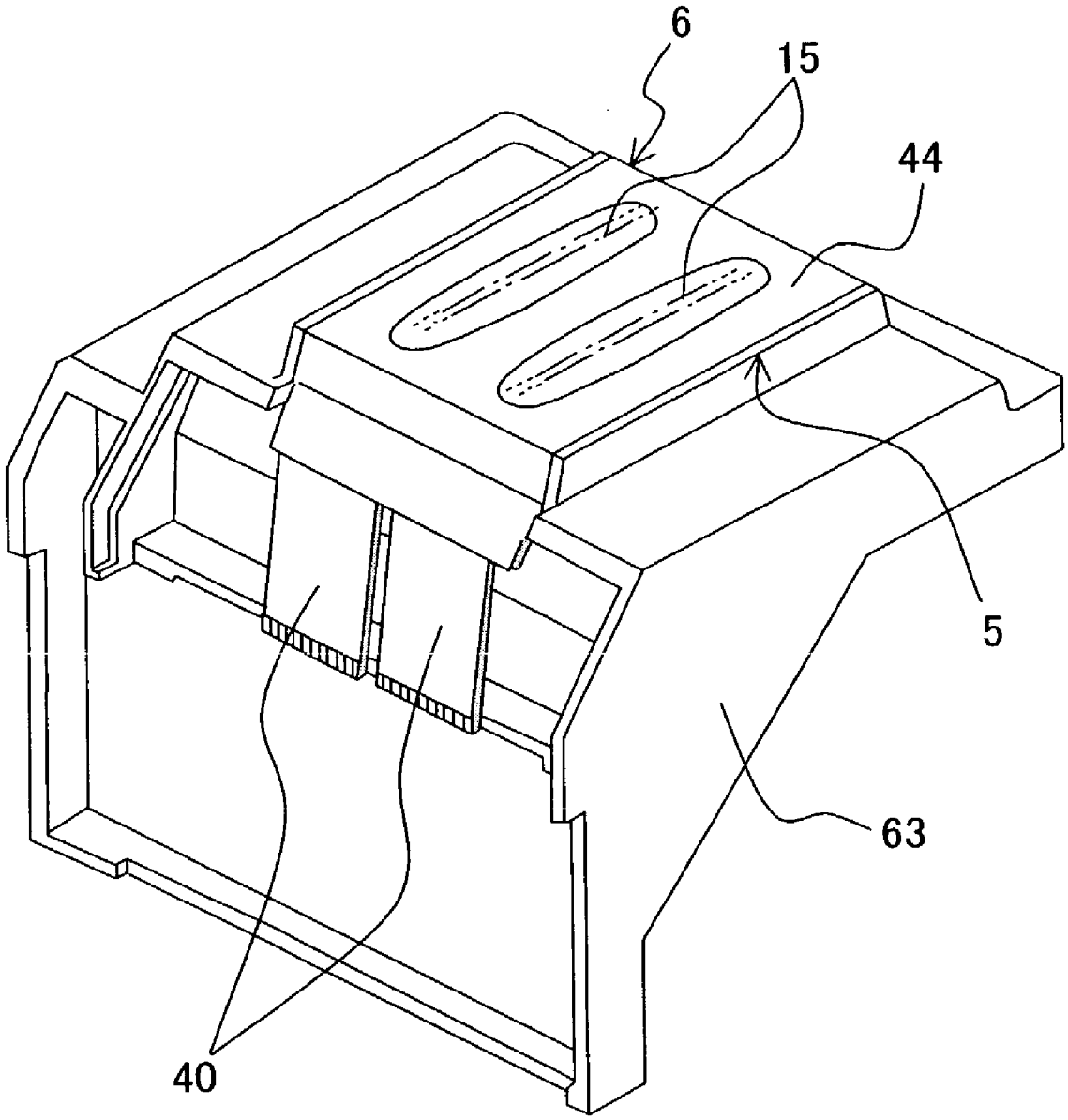
FIG. 2 shows a perspective view illustrating a state in which a head unit 63 is inverted upside down.
Figure 3:
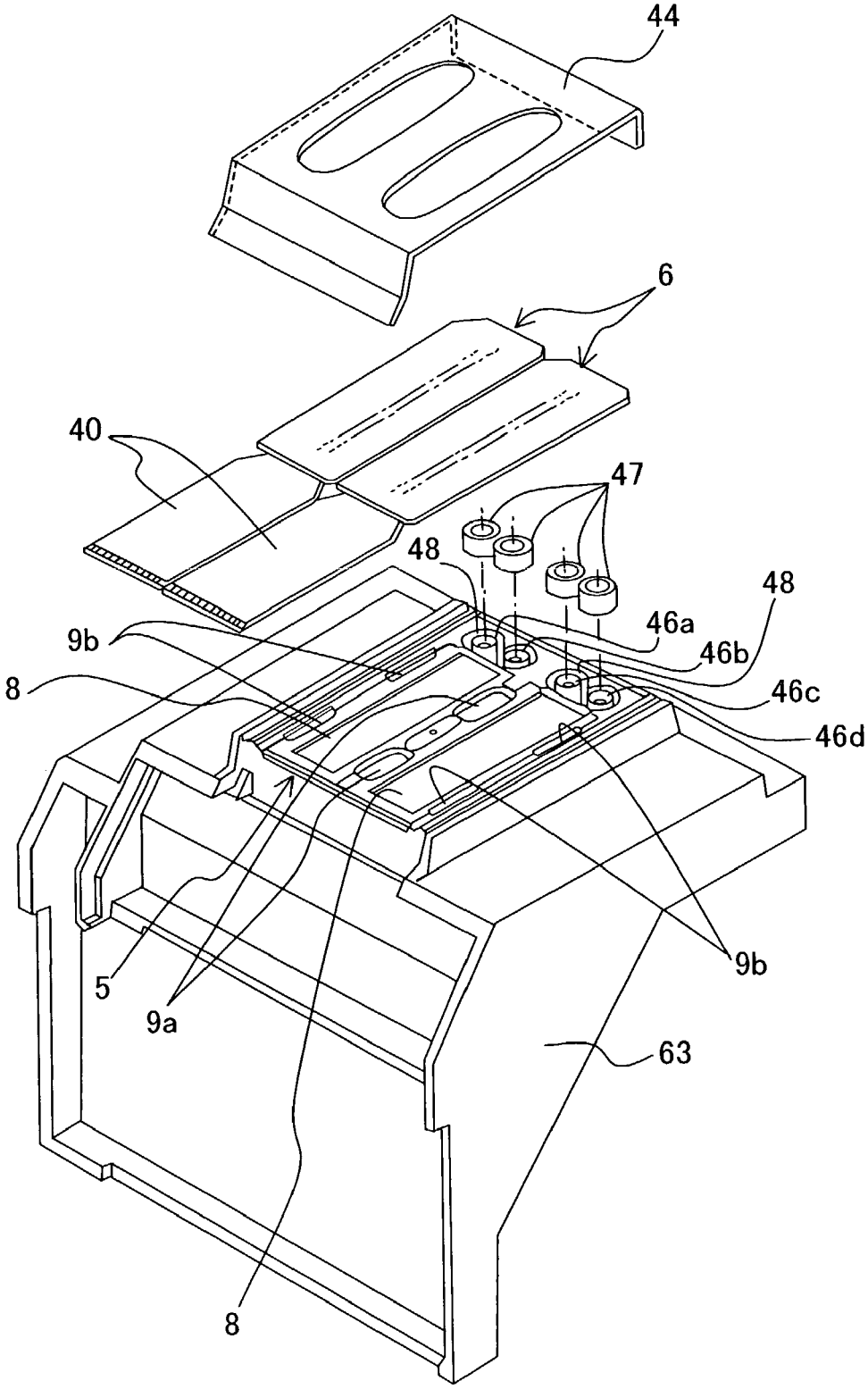
FIG. 3 shows an exploded perspective view illustrating the head unit 63 shown in FIG. 2.
Figure 4:
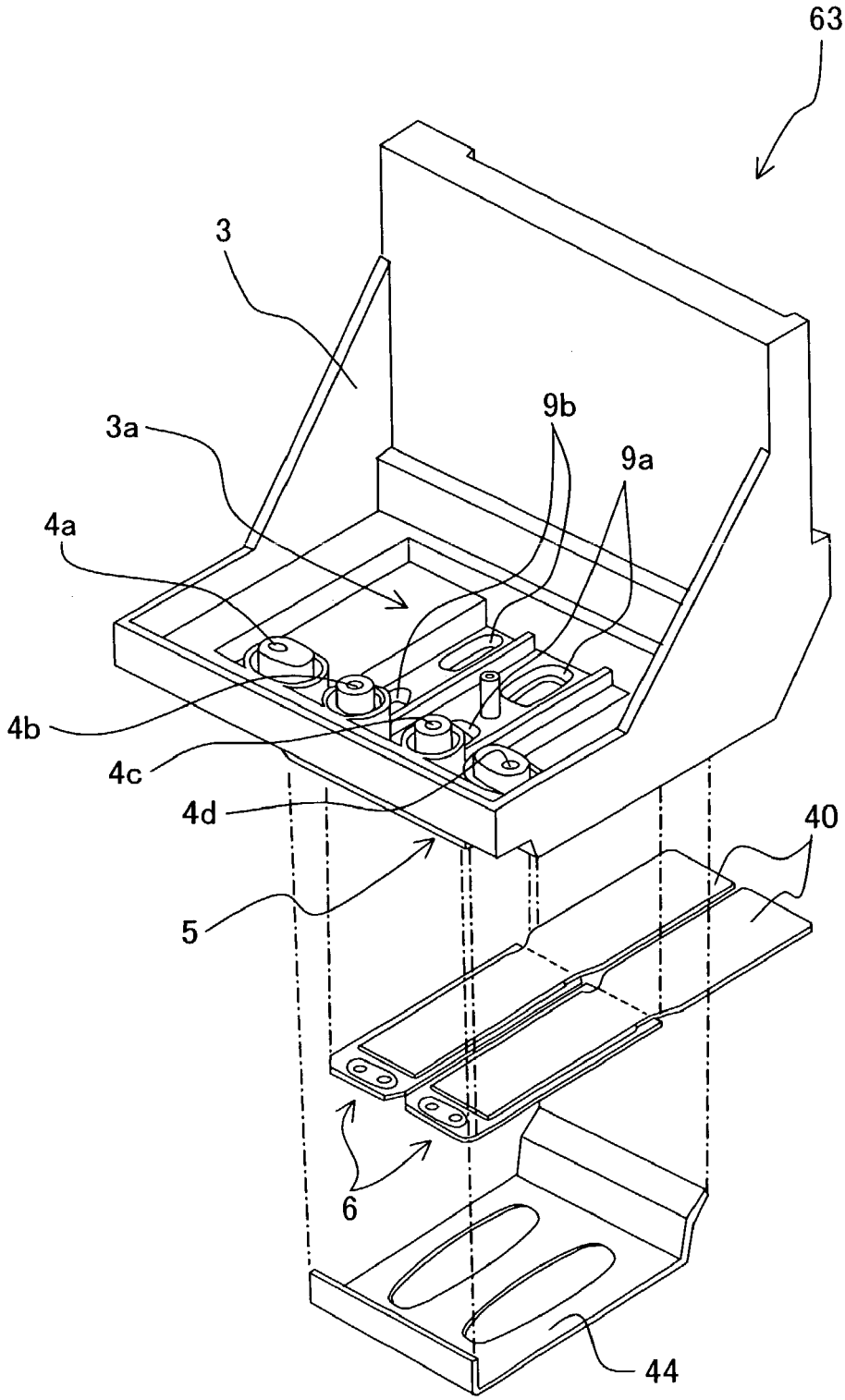
FIG. 4 shows an exploded perspective view illustrating the head unit 63 as viewed from an upper position.
Figure 5:
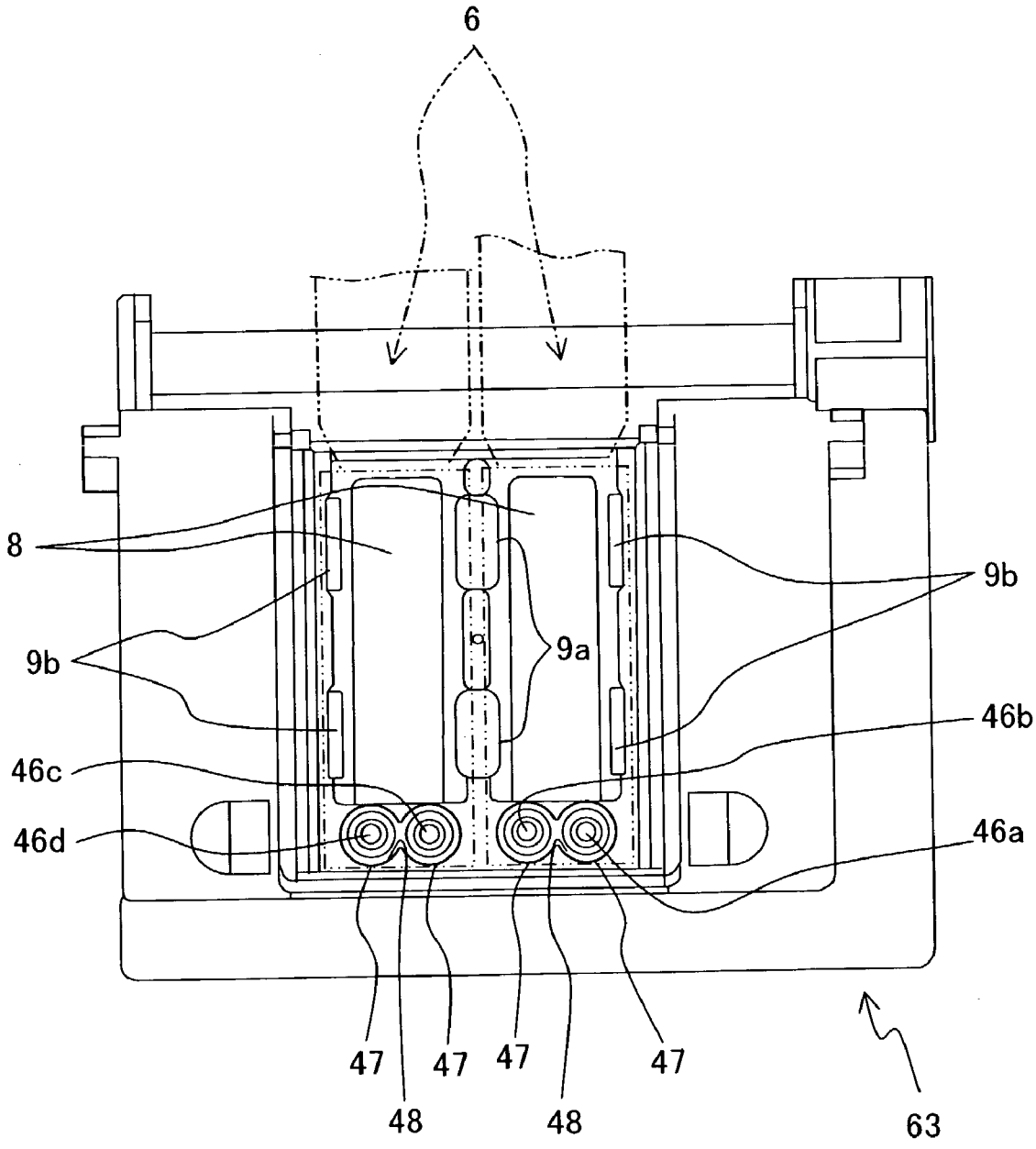
FIG. 5 shows a bottom view illustrating the head unit 63.

Next, the structure of the head unit 63 will be explained with reference to FIGS. 2 to 5. FIG. 2 shows a perspective view illustrating a state in which the head unit 63 is inverted upside down. FIG. 3 shows an exploded perspective view illustrating the head unit 63 shown in FIG. 2. FIG. 4 shows an exploded perspective view illustrating the head unit 63 as viewed from an upper position. FIG. 5 shows a bottom view illustrating the head unit 63.

As shown in FIGS. 2 to 5, the head unit 63, which is carried on the carriage 64 that travels along the printing paper 62, is formed to have a substantially box-shaped configuration with its open upper surface. The head unit 63 has a cartridge-carrying section 3 to which the four ink cartridges 61 can be detachably installed from upper positions thereof. Ink supply passages 4*a*, 4*b*, 4*c*, 4*d*, which are connectable to ink release sections (not shown) of the respective ink cartridges 61, are disposed at a side portion 3*a* of the cartridge-carrying section 3 to make communication down to the lower surface of the bottom plate 5 of the head unit 63. Packings made of rubber or the like (not shown), which are capable of making tight contact with the ink release sections (not shown) of the respective ink cartridges 61, are arranged on the upper surface of the side portion 3*a* of the cartridge-carrying section 3.

The bottom plate 5 is formed horizontally while protruding by one step from the cartridge-carrying section 3. As shown in FIGS. 3 and 5, two support sections 8, which are provided to arrange the two piezoelectric ink-jet heads 6 in parallel, are formed in a stepped form on the side of the lower surface of the bottom plate 5. A plurality of hollow spaces 9*a*, 9*b*, which are provided to effect fixation with UV-curable adhesive, are formed for the respective support sections 8 to make penetration in the vertical direction.

Communicating sections 46*a*, 46*b*, 46*c*, 46*d*, which make communication with the ink cartridges 61 via the ink supply passages 4*a* to 4*d*, are provided at first ends of the respective support sections 8. Fitting grooves 48, which are, for example, 8-shaped as viewed in the plan view, are recessed at the outer circumferences of the communicating sections 46*a* to 46*d*. Ring-shaped packings 47 made of rubber or the like are inserted into the fitting grooves 48. When the piezoelectric ink-jet heads 6 are adhered and fixed to the support sections 8, then the tips of the packings 47 are pressed against the outer circumferences of ink supply ports 19*a* (see FIG. 8) of the piezoelectric ink-jet heads 6 as described later on, and the portions of abutment against the ink supply ports 19*a* are tightly closed.

A protecting cover 44, which is provided to protect the adhered and fixed piezoelectric ink-jet heads 6, is attached to cover the bottom plate 5 to which the piezoelectric ink-jet heads 6 are fixed. The protecting cover 44 has two elliptic openings which are provided in the longitudinal direction of the protecting cover 44 so that the nozzles 15 of the piezoelectric ink-jet heads 6 are exposed. The protecting cover 44 has both ends in the longitudinal direction which are folded in a substantially ]-shaped (angular U-shaped) configuration. Flexible flat cables 40 of the piezoelectric ink-jet heads 6 are fixed while being folded in the upward direction of the head unit 63 to extend along the folding lines when the protecting cover 44 is fixed.

Figure 6:
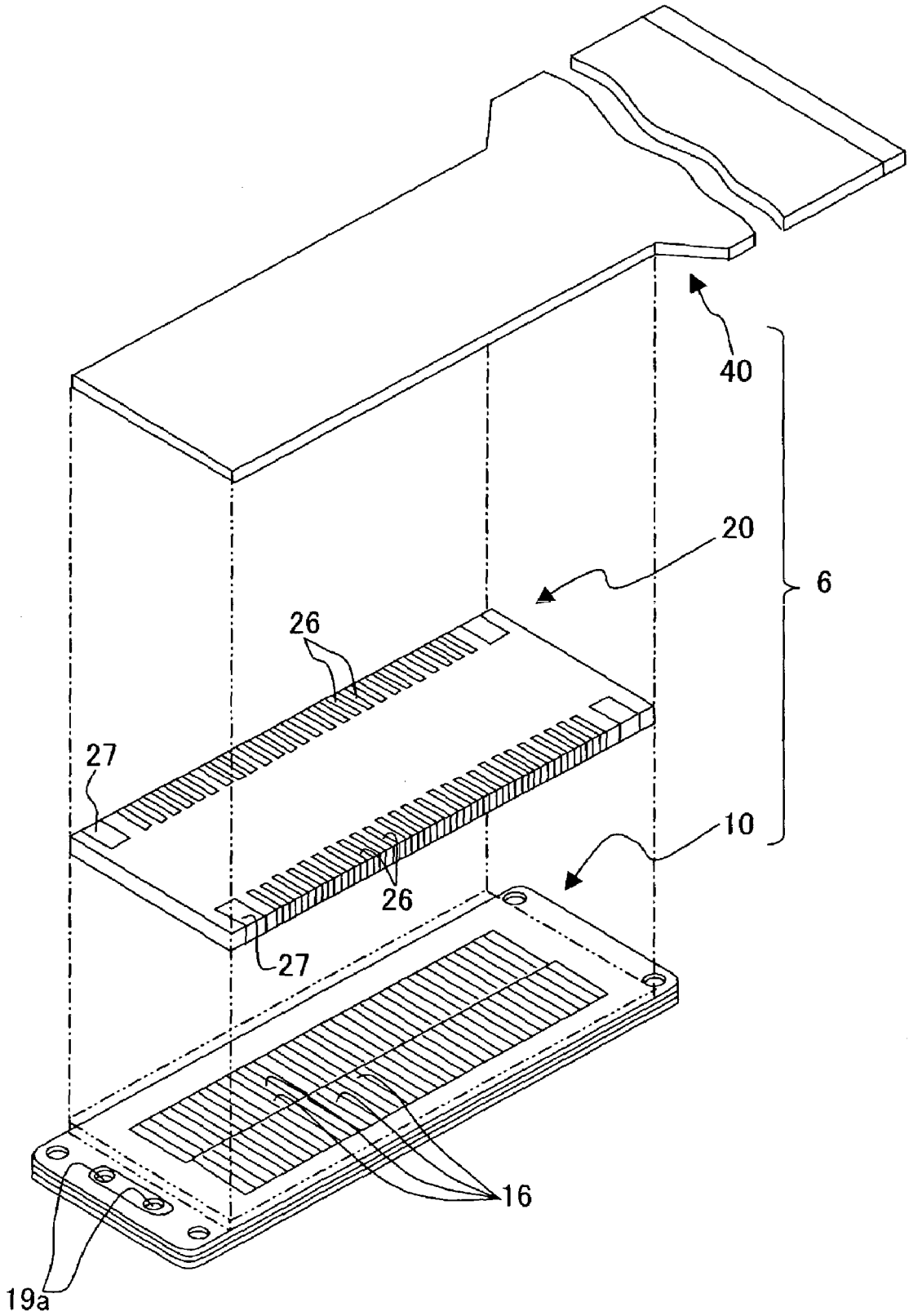
FIG. 6 shows an exploded perspective view illustrating a piezoelectric ink-jet head 6.
Figure 7:
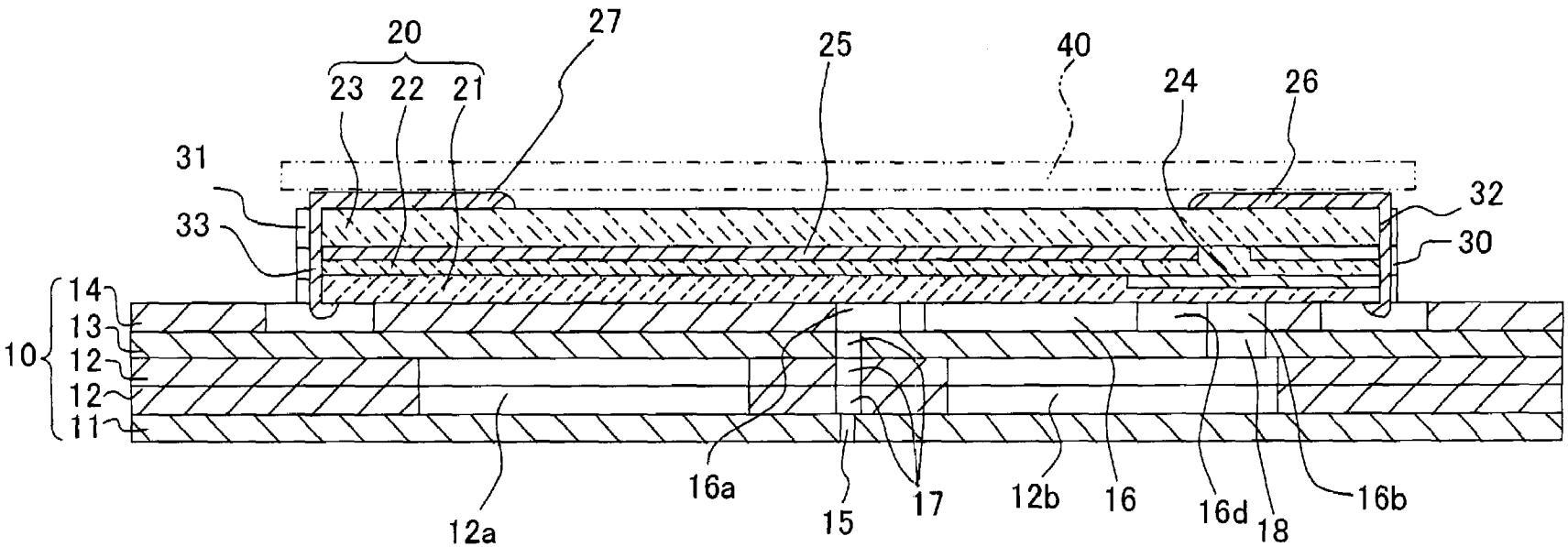
FIG. 7 shows a side sectional view illustrating the piezoelectric ink-jet head 6.
Figure 8:
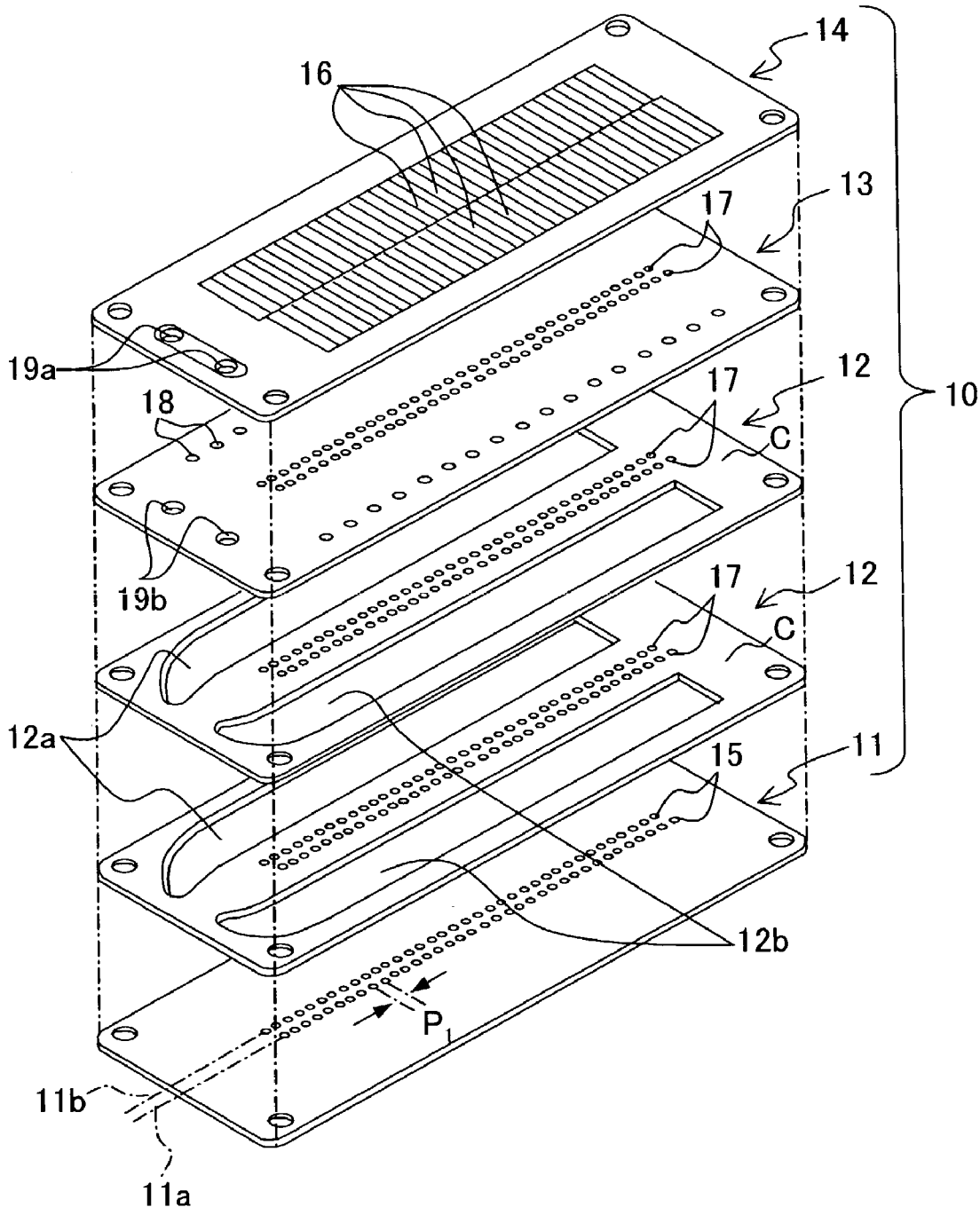
FIG. 8 shows an exploded perspective view illustrating a cavity plate 10.
Figure 9:
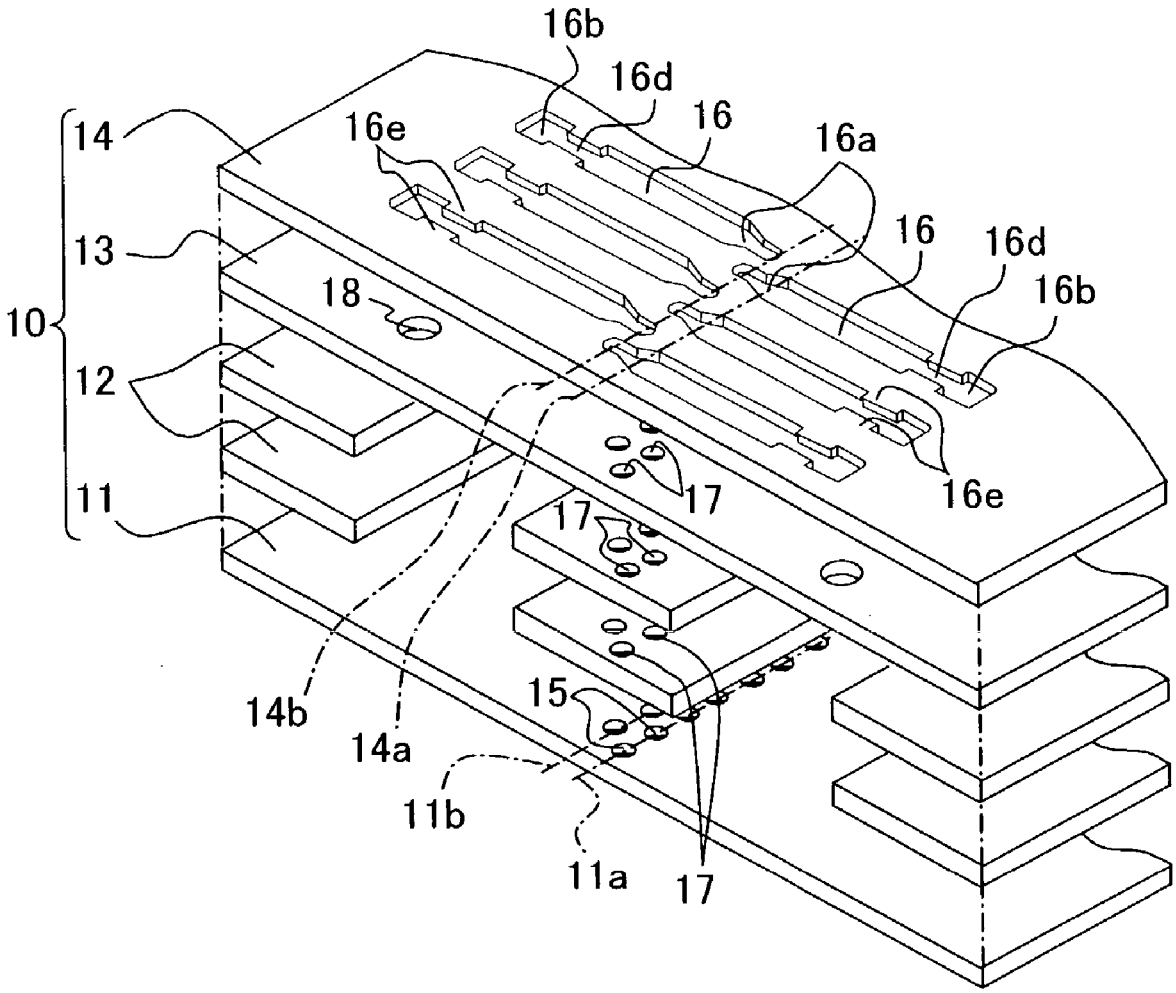
FIG. 9 shows an exploded perspective view illustrating magnified main components of the cavity plate 10.
Figure 10:
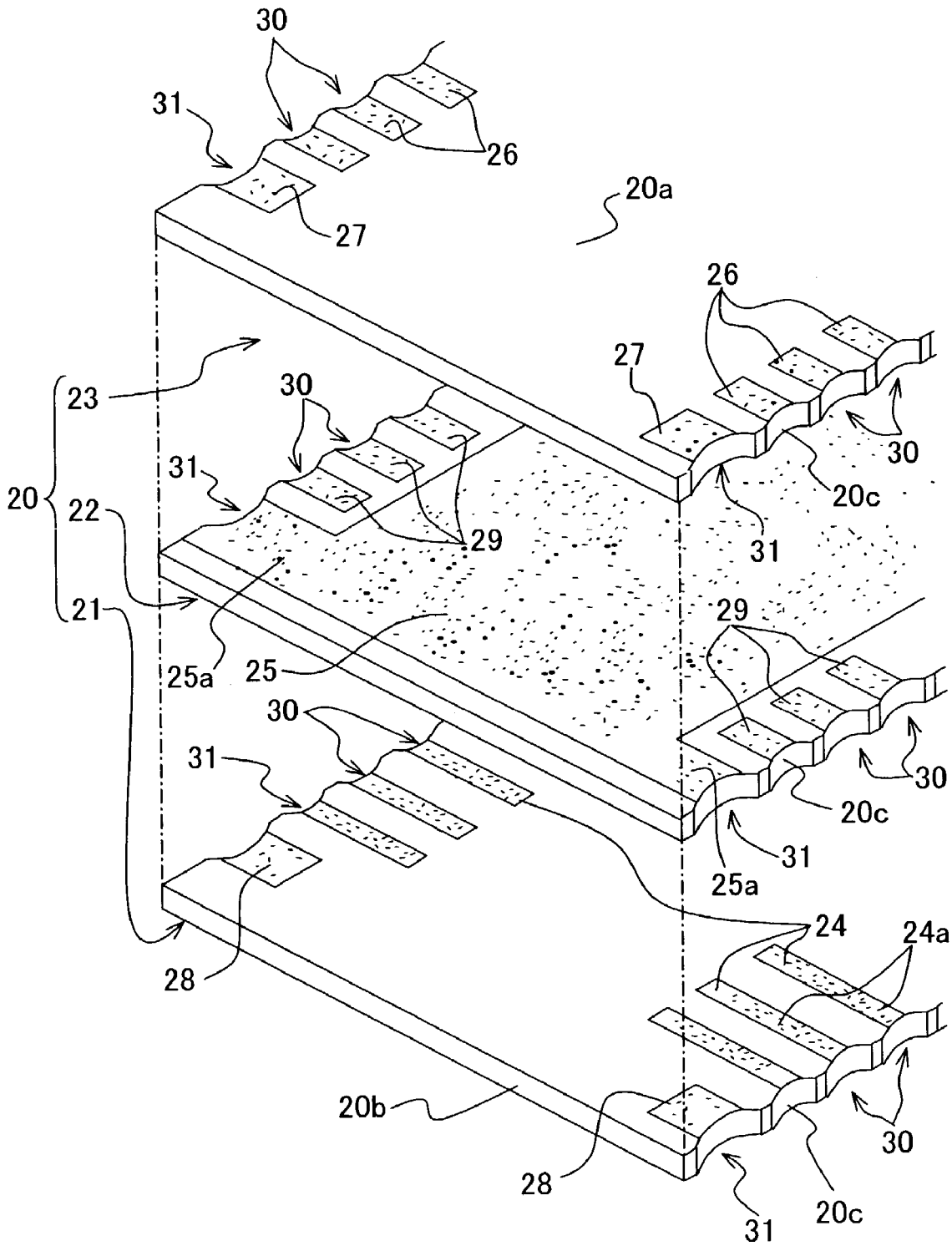
FIG. 10 shows an exploded perspective view illustrating magnified main components of a piezoelectric actuator 20.

Next, the structure of the piezoelectric ink-jet head 6 will be explained with reference to FIGS. 6 to 10. FIG. 6 shows an exploded perspective view illustrating the piezoelectric ink-jet head 6. FIG. 7 shows a side sectional view illustrating the piezoelectric ink-jet head 6. FIG. 8 shows an exploded perspective view illustrating a cavity plate 10. FIG. 9 shows an exploded perspective view illustrating magnified main components of the cavity plate 10. FIG. 10 shows an exploded perspective view illustrating magnified main components of a piezoelectric actuator 20.

As shown in FIGS. 6 and 7, the piezoelectric ink-jet head 6 is constructed by laminating and joining, with an adhesive, the stacked type cavity plate 10 which is composed of a plurality of sheets, the plate type piezoelectric actuator 20 which is adhered and stacked onto the cavity plate 10 by the aid of the adhesive or an adhesive sheet, and the flexible flat cable 40 which is disposed on the upper surface of the piezoelectric actuator 20 in order to effect electric connection to an external apparatus. The ink is jetted downwardly from the nozzles 15 which are open on the lower surface side of the cavity plate 10 disposed at the lowermost layer.

On the other hand, as shown in FIG. 8, the cavity plate 10 has such a structure that five thin metal plates, i.e., a nozzle plate 11, two manifold plates 12, a spacer plate 13, and a base plate 14 are superimposed and stacked with an adhesive respectively. In the embodiment of the present invention, each of the plates 11 to 14 is made of 42% nickel alloy steel plate (42 alloy) having a thickness of about 50 μm to 150 μm. Each of the plates 11 to 14 may be formed of, for example, a resin without being limited to the metal.

Figure 12:
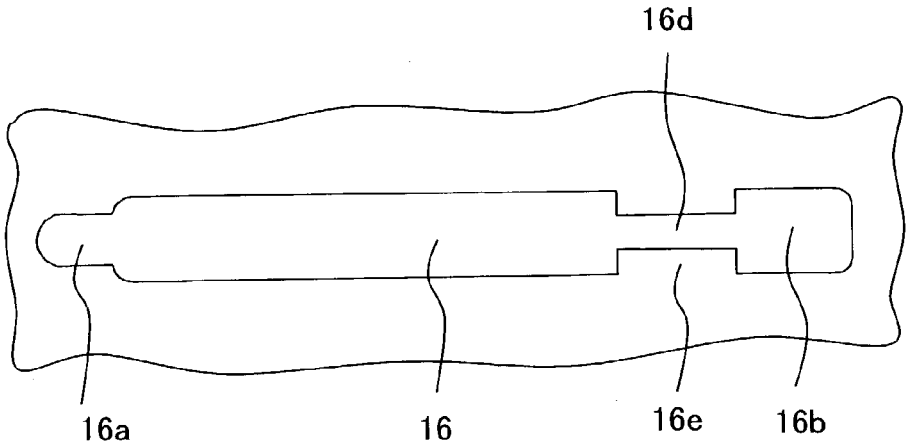
FIG. 12 shows a horizontal sectional view taken along a line A–A' shown in FIG. 11.

As shown in FIG. 9, a plurality of pressure chambers 16, each of which has a thin width and which extend in a direction perpendicular to center lines 14*a*, 14*b* in the longitudinal direction, are bored through the base plate 14 in two arrays of zigzag arrangement. Ink supply holes 16*b* are bored at positions located outwardly from the respective pressure chambers 16 toward the both ends of the base plate 14 in the transverse direction of the base plate 14 respectively corresponding to the respective pressure chambers 16. The respective pressure chambers 16 and the respective ink supply holes 16*b* are connected to one another by throttle sections 16*d* which are formed therebetween. The respective ink supply holes 16*b* are communicated with common ink chambers 12*a*, 12*b* of the manifold plates 12 via respective ink supply holes 18 which are bored through left and right portions on the both sides in the transverse direction of the spacer plate 13. In this embodiment, as shown in FIG. 12, the throttle section 16*d* is formed such that the spacing distance between left and right walls (walls for constituting connecting sections 16*e* as described later on) of the base plate 14 for constituting the throttle section is smaller than the spacing distances between left and right walls for constituting the pressure chamber 16 and the ink supply hole 16*b*, for the following reason. That is, it is intended to increase the flow passage resistance to the counterflow toward the ink supply hole 16*b* during the ink-jetting operation as described later on by decreasing the cross-sectional area of the throttle section 16*d* in the direction perpendicular to the direction of the flow of the ink. First ends 16*a* of the respective pressure chambers 16 are communicated with the nozzles 15 disposed in the zigzag arrangement in the nozzle plate 11, via through-holes 17 each having a minute diameter bored in the zigzag arrangement as well through the spacer plate 13 and the two manifold plates 12.

As shown in FIG. 8, the ink supply holes 19*a*, 19*b*, which are provided to supply the inks from the ink cartridges 61 to the common ink chambers 12*a*, 12*b* of the manifold plates 12, are bored through the base plate 14 and the spacer plate 13 respectively. The two manifold plates 12 are provided with the two common ink chambers 12*a*, 12*b* which extend in the longitudinal direction while interposing the arrays of the plurality of nozzles 15 of the nozzle plate 11. The common ink chambers 12*a*, 12*b* are formed as openings which penetrate through the respective manifold plates 12. One common ink chamber is formed by the openings which are superimposed in the vertical direction. One common ink chamber 12*a* is communicated with the pressure chambers 16 disposed in one array, and the other common ink chamber 12*b* is communicated with the pressure chambers 16 disposed in the other array. The respective common ink chambers 12*a*, 12*b* are positioned in the plane parallel to the plane formed by the plurality of pressure chambers 16 of the base plate 14. Further, the respective common ink chambers 12*a*, 12*b* are formed to extend by longer distances in the direction of the arrays formed by the plurality of pressure chambers 16 on the side of the nozzle plate 11 as compared with the plurality of pressure chambers 16.

The common ink chambers 12*a*, 12*b* are structured such that they are tightly closed by stacking the nozzle plate 11 and the spacer plate 13 on the two manifold plates 12. The portion 13*a* of the spacer plate 13, which forms the bottom of each of the pressure chambers 16, forms the upper surface of each of the common ink chambers 12*a*, 12*b*. The portion 13*a* of the spacer plate 13 is bendable toward each of the common ink chambers 12*a*, 12*b* owing to the resilience.

The plurality of nozzles 15 for jetting the inks, each of which has a minute diameter (about 25 μm in this embodiment), are bored through the nozzle plate 11 in the zigzag arrangement at spacing distances of minute pitches $P_1$ along center lines 11*a*, 11*b* in the longitudinal direction of the nozzle plate 11. The respective nozzles 15 correspond to respective through-holes 17 bored through the manifold plates 12.

The cavity plate 10 is constructed as described above. Accordingly, the ink, which inflows into each of the common ink chambers 12*a*, 12*b* from the ink cartridge 61 via each of the ink supply holes 19*a*, 19*b* bored at the first ends of the base plate 14 and the spacer plate 13, passes from each of the common ink chambers 12*a*, 12*b* through the respective ink supply holes 18, the respective ink supply holes 16*b*, and the throttle sections 16*d*, and the ink is distributed to the respective pressure chambers 16. The ink flows in the direction toward the first ends 16*a* of the respective pressure chambers 16. The ink passes through the respective through-holes 17, and it arrives at the nozzles 15 corresponding to the respective pressure chambers 16.

On the other hand, as shown in FIG. 10, the piezoelectric actuator 20 is structured such that two piezoelectric sheets 21, 22 and one insulating sheet 23 are stacked. A plurality of driving electrodes 24, each of which has a thin width and which correspond to the respective pressure chamber 16 of the cavity plate 10 one by one, are provided in the zigzag arrangement on the upper surface of the piezoelectric sheet 21 disposed at the lowermost level. First ends 24*a* of the respective driving electrodes 24 are formed to be exposed to left and right side surfaces 20*c* which are perpendicular to front and back surfaces 20*a*, 20*b* of the piezoelectric actuator 20.

Figure 11:
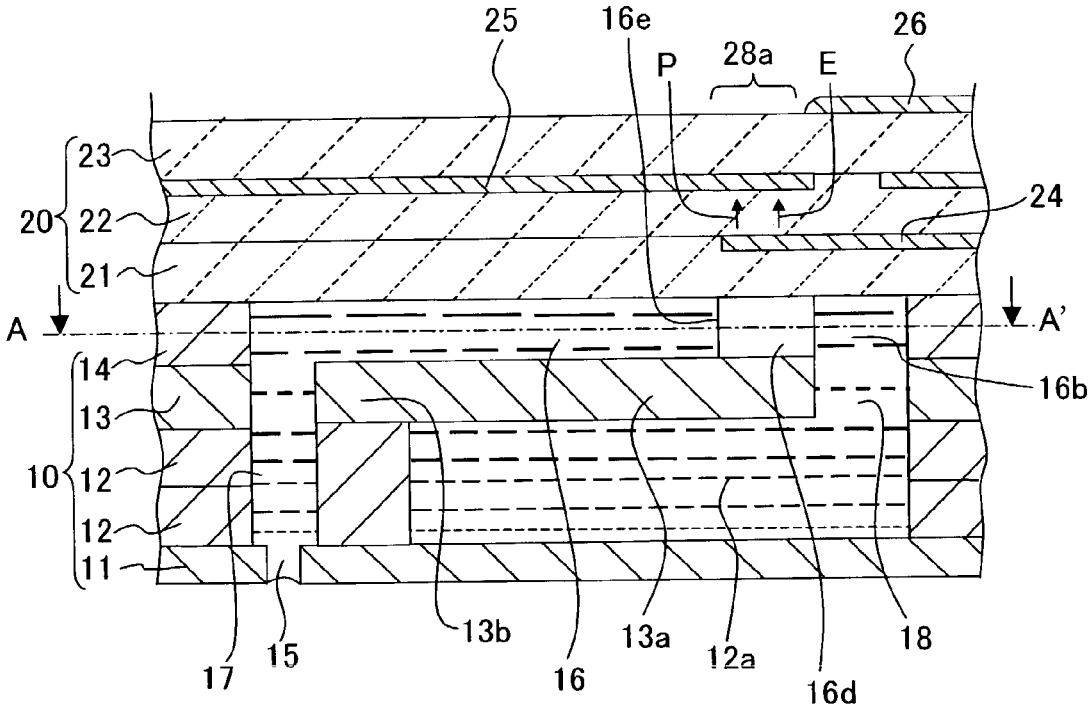
FIG. 11 shows a magnified sectional view illustrating main components of the piezoelectric ink-jet head 6 shown in FIG. 7.

A common electrode 25, which is common to the plurality of pressure chambers 16, is provided on the upper surface of the piezoelectric sheet 22 disposed at the next level. First ends 25*a* of the common electrode 25 are also formed to be exposed to the left and right side surfaces 20*c* in the same manner as the first ends 24*a* of the respective driving electrodes 24. As shown in FIG. 11, respective regions of the piezoelectric sheet 22, i.e., pressure-generating sections 28*a*, which are interposed between the respective driving electrodes 24 and the common electrode 25, are subjected to the polarization treatment in a direction directed from the driving electrodes 24 to the common electrode 25. The pressure-generating sections 28*a* are connected to the portions 13*a* of the spacer plate 13 disposed at the bottoms of the pressure chambers 16 via the walls on the both sides of the respective throttle sections 16*d*, i.e., the connecting sections 16*e*. In other words, the pressure-generating sections 28*a* are provided only at the positions corresponding to the connecting sections 16*e*. This embodiment is constructed such that the area occupied by the pressure-generating sections 28*a* is about 20% of the area occupied by the pressure chambers 16.

Surface electrodes 26 corresponding to the respective driving electrodes 24 one by one and surface electrodes 27 corresponding to the common electrode 25 are provided on the upper surface of the insulating sheet 23 disposed at the uppermost level so that the surface electrodes 26, 27 are aligned along the left and right side surfaces 20*c*. First recessed grooves 30 are provided for the first ends 24*a* of the respective driving electrodes 24 and second recesses grooves 31 are provided for the first ends 25*a* of the common electrode 25 so that the first and second recessed grooves 30, 31 extend in the stacking direction on the left and right side surfaces 20*c* respectively. As shown in FIG. 7, a side surface electrode 32, which electrically connects each of the driving electrodes 24 and each of the surface electrodes 26, is formed in each of the first recessed grooves 30. Further, a side surface electrode 33, which electrically connects the common electrode 25 and each of the surface electrodes 27, is formed in each of the second recessed grooves 31. Electrodes designated by reference numerals 28 and 29 are electrodes of extra patterns.

The size of the main components constructing the piezoelectric actuator of the present embodiment is indicated as below.

Length of the pressure chamber 16 (in the direction perpendicular to 14*a*): 3.7 mm Width of the pressure chamber 16 (in the direction parallel to 14*a*): 0.13 mm Depth of the pressure chamber 16 (the thickness of the base plate): 0.05 mm Width of the driving electrode 24: 0.1 mm Thickness of the piezoelectric sheets 21, 22: 0.03 mm Diameter of the nozzle 15: 0.025 mm Next, the operation of the piezoelectric ink-jet head 6 will be explained. FIG. 11 shows a magnified sectional view illustrating main components of the piezoelectric ink-jet head 6 shown in FIG. 7. As shown in FIG. 11, the common ink chamber 12*a* and the pressure chamber 16 are filled with the ink.

Figure 13:
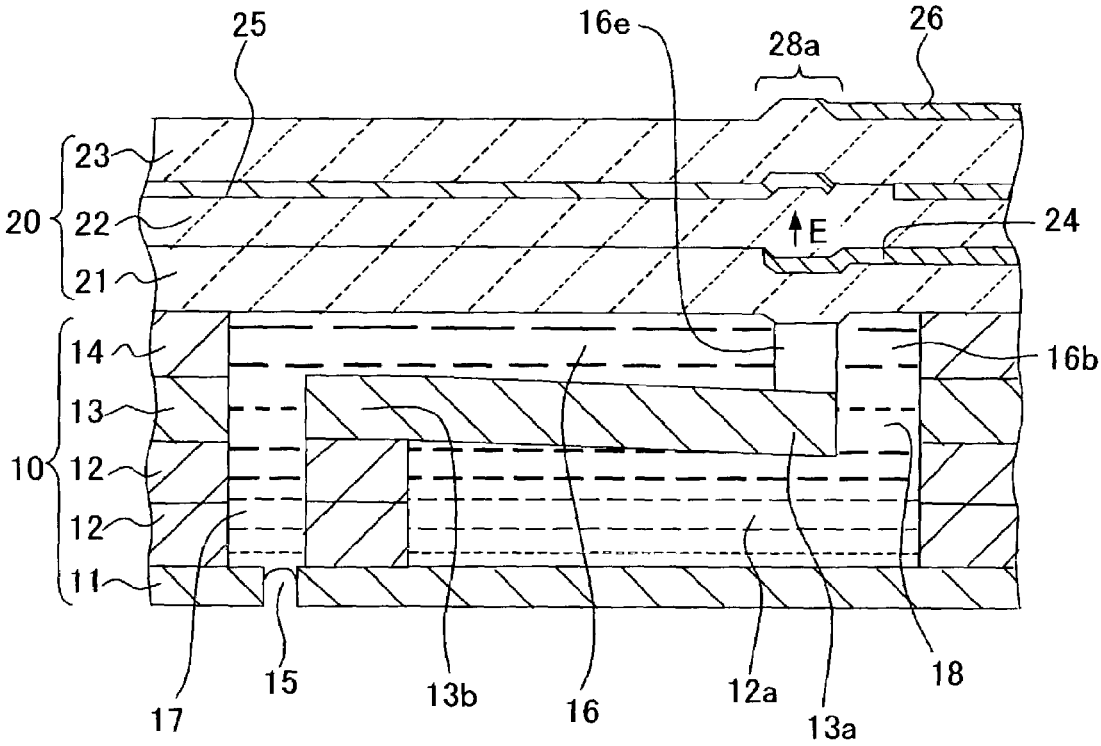
FIG. 13 shows a magnified sectional view illustrating the operation of the piezoelectric ink-jet head 6.

As shown in FIG. 13, when a positive voltage is applied to an arbitrary driving electrode 24 of the respective driving electrodes 24 of the piezoelectric actuator 20 of the piezoelectric ink-jet head 6, and the common electrode 25 is connected to the ground, then the electric field E is generated between the electrodes in the direction which is coincides with the direction of polarization P, and the pressure-generating section 28*a* is elongated in the stacking direction owing to the piezoelectric vertical effect. The pressure-generating section 28*a* was elongated in the stacking direction by $20\times10^{-6}$ mm.

Figure 28:
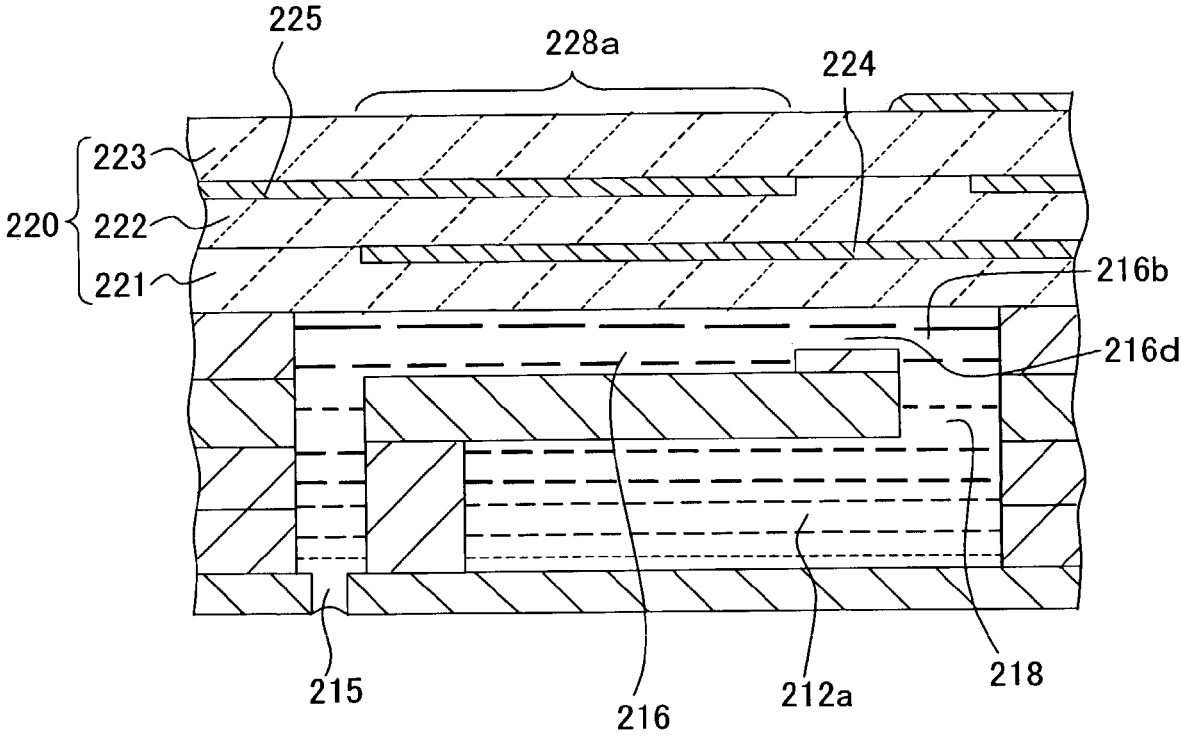
Fig. 28 RELATED ART
FIG. 28 shows a magnified sectional view illustrating a conventional piezoelectric ink-jet head.

The elongation causes the pushing action on the portion 13*a* of the spacer plate 13 which forms the bottom of the pressure chamber 16 toward the common ink chamber 12*a* via the connecting section 16*e*. The portion 13*a* is displaced about the support point of the fixed portion 13*b* formed between the spacer plate 13 and the manifold plate 12 in the vicinity of the through-hole 17. It was found out that by the displacement of the portion 13*a*, the volume of the pressure chamber was increased by $3.98\times10^{-6}$ $mm^3$. Further, in the piezoelectric actuator of the conventional structure as shown in FIG. 28, when the pressure-generating section 228*a* had the same area as that of the pressure-generating section 28*a* shown in FIG. 13, the volume of the pressure chamber was decreased by $1.70\times10^{-6}$ $mm^3$ by the elongation of the pressure-generating section 228*a* in the stacking direction. Namely, owing to the provision of the connecting section 16*e*, the piezoelectric actuator of the present invention has realized a pull-eject in which the change of volume is relatively large. Further, it is noted that when the pressure-generating section 28*a* is elongated, the displacement of the connecting section 16*e* does not directly influence the change of volume of the pressure chamber, and the connecting section 16*e* displaces the portion 13*a* to indirectly change the volume of the pressure chamber.

Figure 14:
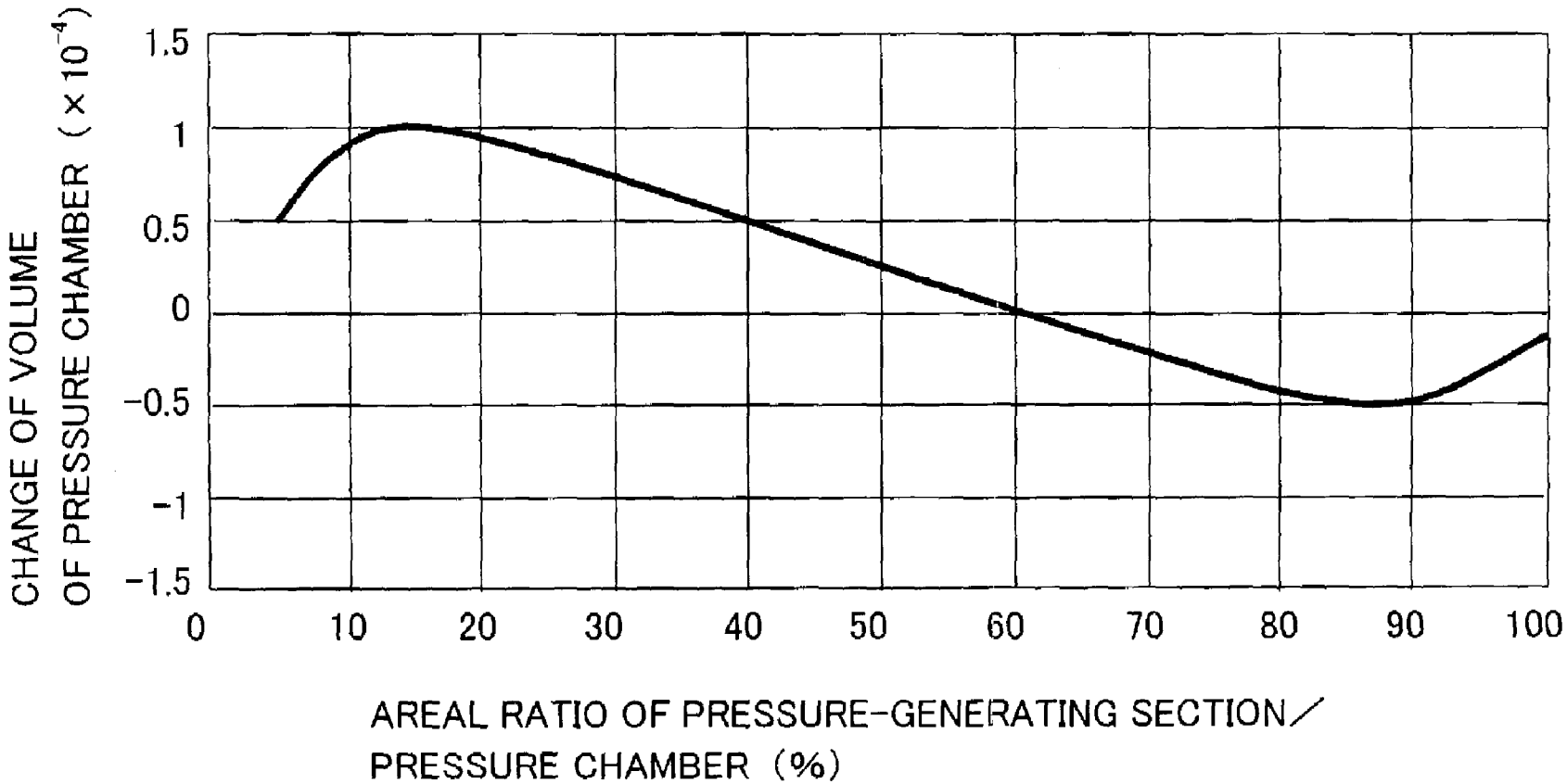
FIG. 14 shows a relationship between the areal ratio of pressure-generating section/pressure chamber and the change of volume of the pressure chamber.

FIG. 14 shows a relationship between the areal ratio of pressure-generating section/pressure chamber and the change of the volume of the pressure chamber. As shown in FIG. 14, if the area of the pressure-generating section 28*a* exceeds about 60% with respect to the pressure chamber 16, the volume of the pressure chamber 16 is changed to cause the decrease. In this case, the jetting method, which is so-called the push-eject, is performed. On the contrary, when the area of the pressure-generating section 28*a* is smaller than about 60% with respect to the pressure chamber 16, the volume of the pressure chamber 16 is changed to cause the increase. In other words, a volumetric change of the pressure chamber 16 caused by displacement of the portion 13*a* is greater than that caused directly by displacement of the pressure-generating section 28*a*. Therefore, it is possible to perform the so-called pull-eject in which the volume of the pressure chamber 16 is firstly increased and then the volume is restored to the original volume. As clarified from FIG. 14, when the pressure-generating section 28*a* is set to 5% to 40% with respect to the pressure chamber 16, it is possible to obtain the volume change in order to jet the ink droplets having necessary volumes by means of the pull-eject. Further, when the area of the pressure-generating section 28*a* is about 10% to 20% of the area of the pressure chamber, then the volume change of the pressure chamber 16 can be increased to be not less than $0.9\times10^{-4}$, and it is possible to obtain the sufficient performance. The area of the pressure-generating section means an area of the pressure-generating section interposed between the driving electrode 24 and the common electrode 25 in the piezoelectric actuator 20. The area of the pressure chamber is an area of the pressure chamber 16 except for the both ends (the first ends 16*a*, the throttle sections 16*d*, the ink supply holes 16*b*), and means an area of the wall surface which defines the pressure chamber and which is displaceable in a direction in which a volume of the pressure chamber is varied.

The state, in which the volume of the pressure chamber 16 is expanded, is maintained by a period of one-way transmission time T of the generated pressure wave in the pressure chamber 16. By doing so, the ink, which corresponds to the increased volume of the pressure chamber 16, is supplied during the period of time from the common ink chamber 12*a* via the ink supply hole 18, the ink supply hole 16, and the throttle section 16*d*.

Figure 15:
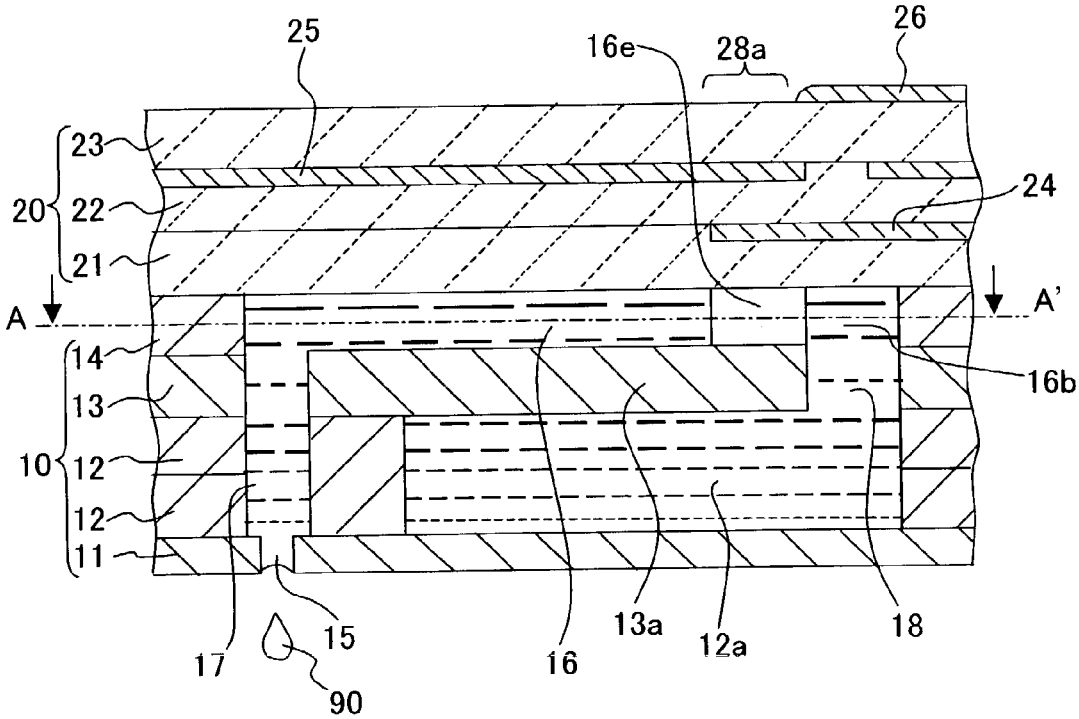
FIG. 15 shows a magnified sectional view illustrating a situation in which ink droplets are jetted by the piezoelectric ink-jet head 6.

The one-way transmission time T is the time which is necessary for the pressure wave in the pressure chamber 16 to be transmitted in the longitudinal direction of the pressure chamber 16 (in the lateral direction on the plane of the drawing paper). The one-way transmission time T is determined as T=L/a by the length L of the pressure chamber 16 and the acoustic velocity "a" in the ink in the pressure chamber 16. According to the pressure wave transmission theory, when an approximate period of time T elapses from the application of the voltage, then the pressure in the pressure chamber 16 is inverted, and the pressure is changed to the positive pressure. When the application of the voltage is stopped in conformity with this timing, then the pressure-generating section 28*a* is contracted to the original state as shown in FIG. 15, and the volume of the expanded pressure chamber 16 is restored to the original volume. Therefore, the pressure is applied to the ink contained in the pressure chamber 16. In this situation, the pressure having been changed to the positive and the pressure generated by the disappearance of strain of the pressure-generating section 28*a* are added to one another, and a relatively high pressure is generated at a portion in the vicinity of the nozzle 15 communicating with the pressure chamber 16. Accordingly, the ink droplets 90 are jetted from the nozzle 15 efficiently as compared with the simple push-eject.

As explained above, in the piezoelectric ink-jet head 6 according to the embodiment of the present invention, the area of the pressure-generating section 28*a* is established within the range of not less than 5% and not more than 40% as compared with the area of the pressure chamber 16. Therefore, the pressure chamber 16 is expanded by the volume change brought about by the displacement of the pressure-generating section 28*a*. Further, the connecting section 16*e*, which serves to transmit the displacement of the pressure-generating section 28*a* to the bottom surface portion of the pressure chamber 16, is provided between the pressure-generating section 28*a* and the bottom surface of the pressure chamber 16. Therefore, the elongation displacement of the pressure-generating section 28*a* depresses the bottom surface of the pressure chamber 16 via the connecting section 16*e* during the application of the voltage, making it easy to perform the pull-eject which is advantageous to achieve the high driving frequency and jet the ink droplets having large volumes. Further, the displacement is caused over the wide area of the pressure chamber 16 by means of the displacement over the small area of the pressure-generating section 28*a*. Therefore, it is possible to decrease the area of the pressure-generating section 28*a*, and it is possible to reduce the electrostatic capacity possessed by the pressure-generating section 28*a*. When the throttle section 16*d* is provided for the connecting section 16*e*, it is unnecessary to increase the number of parts.

Figure 16:
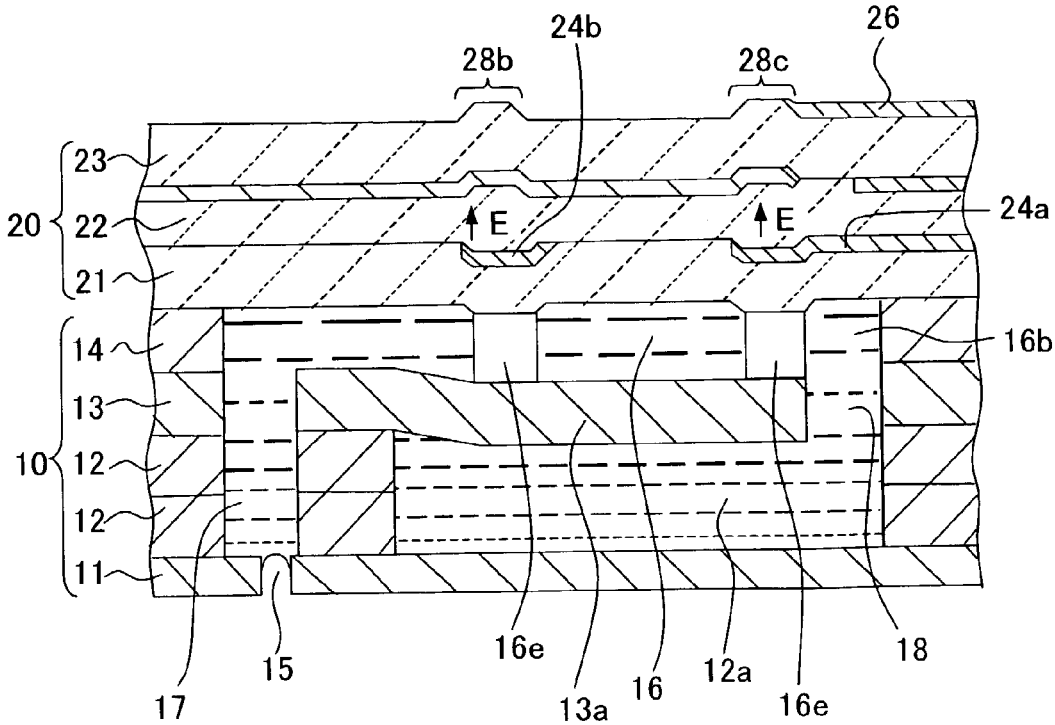
FIG. 16 shows a magnified sectional view illustrating the operation of a piezoelectric ink-jet head according to another embodiment.
Figure 17A:
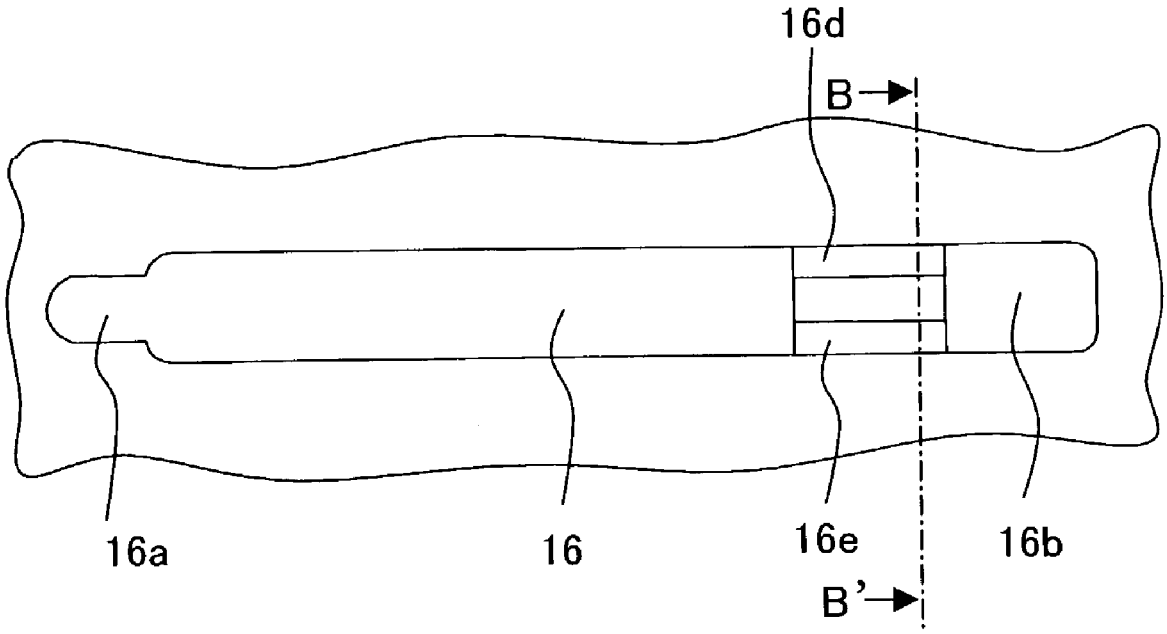
FIG. 17A shows a plan view illustrating a pressure chamber according to still another embodiment.
Figure 17B:
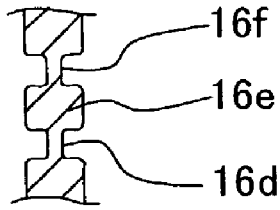
FIG. 17B shows a sectional view taken along a line B–B'.

The present invention is not limited to the embodiment described above, which may be embodied in other various forms of improvements and modifications. For example, the number of pressure-generating section or pressure-generating sections is not limited to one for one pressure chamber. FIG. 16 shows a magnified sectional view illustrating the operation of a piezoelectric ink-jet head according to another embodiment. As shown in FIG. 16, two pressure-generating sections 28*b*, 28*c* each having a small area may be arranged for one pressure chamber 16, and connecting sections 16*e* may be provided at two portions corresponding to the pressure-generating sections 28*b*, 28*c* respectively. Further, as shown in FIG. 17, the following configuration may be also available. That is, a pressure chamber 16 has a substantially uniform width ranging to an ink supply hole 16*b*, and a connecting section 16*e* is connected to the base plate 14 via a thin-walled section 16*f*. In this arrangement, a throttle section 16*d* is formed by the thin-walled section 16*f*.

Second Embodiment

Another embodiment of the droplet-jetting device according to the present invention will be explained with reference to FIGS. 12 to 27. The droplet-jetting device of this embodiment is constructed in the same manner as in the first embodiment except that the structure of the piezoelectric ink-jet head is changed.

Figure 18:
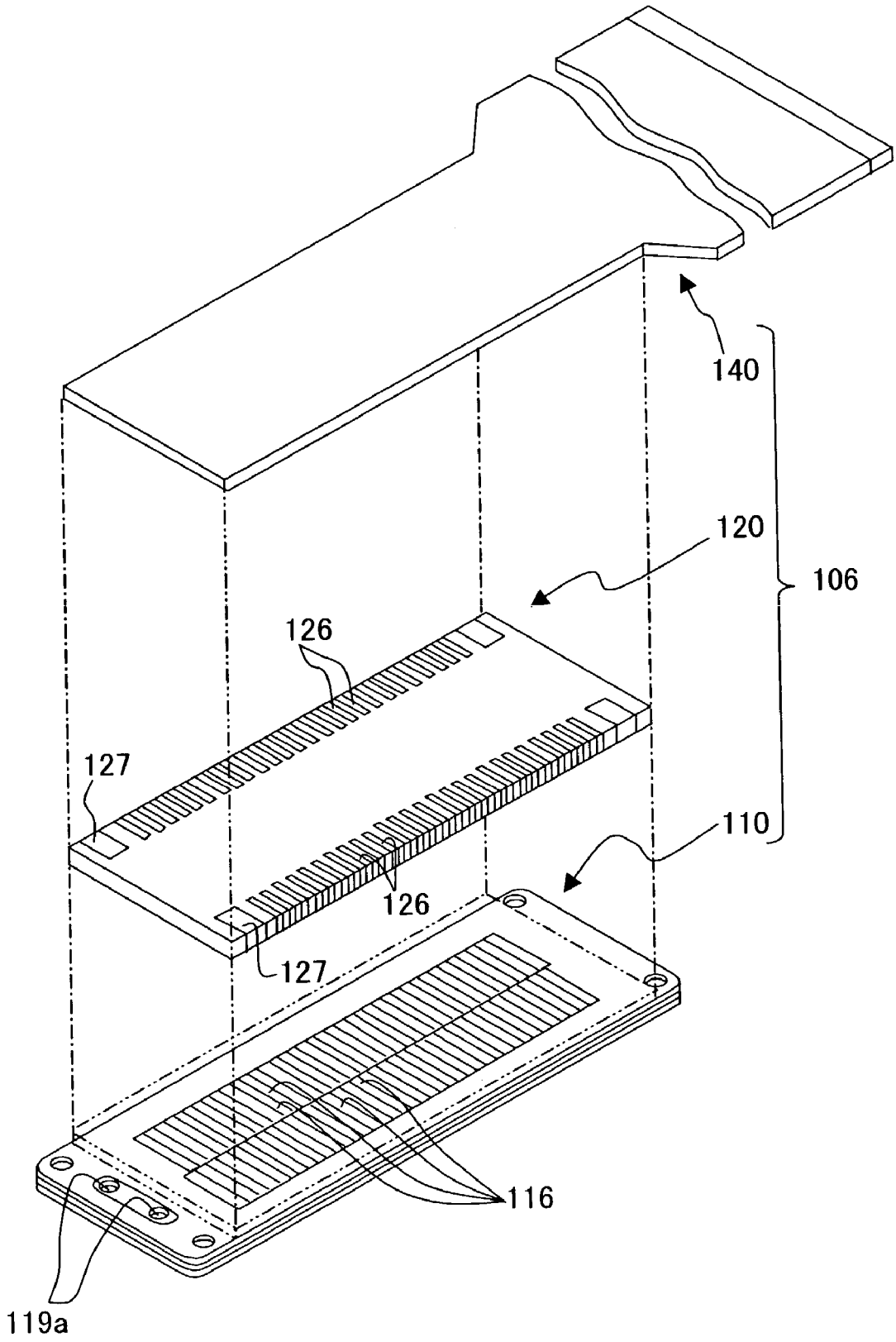
FIG. 18 shows an exploded perspective view illustrating a piezoelectric ink-jet head 106.
Figure 19:
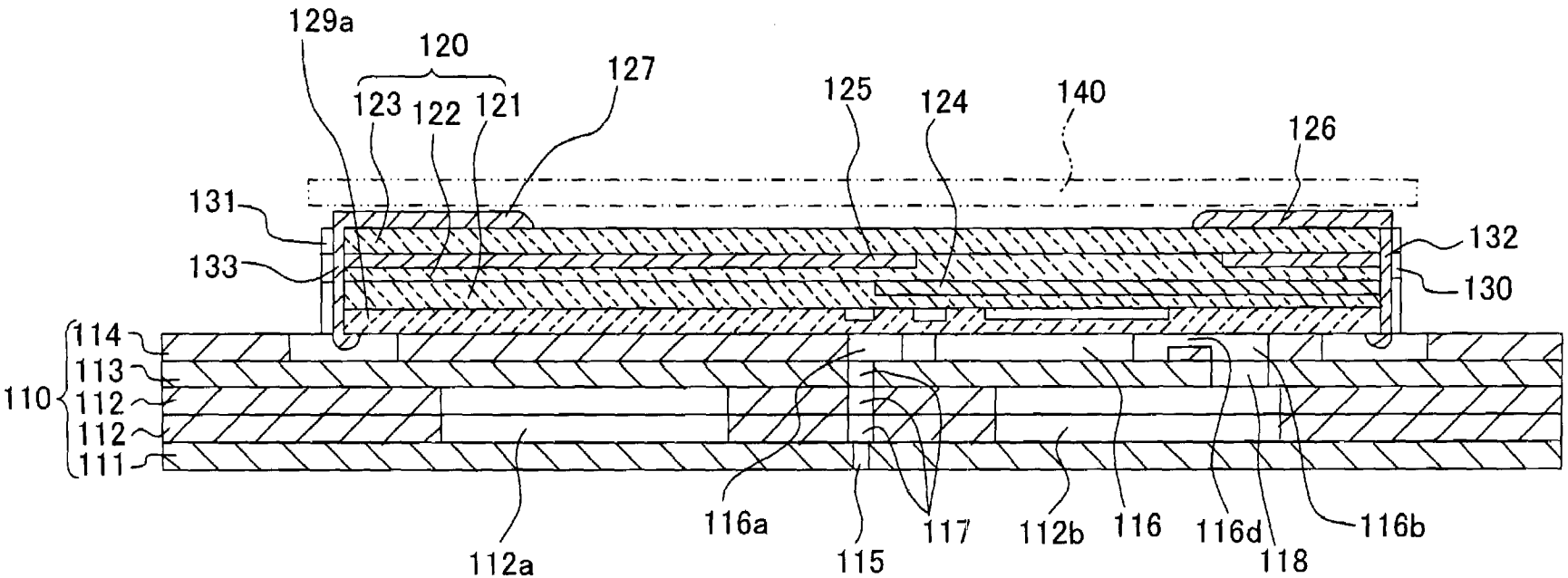
FIG. 19 shows a side sectional view illustrating the piezoelectric ink-jet head 106.
Figure 20:
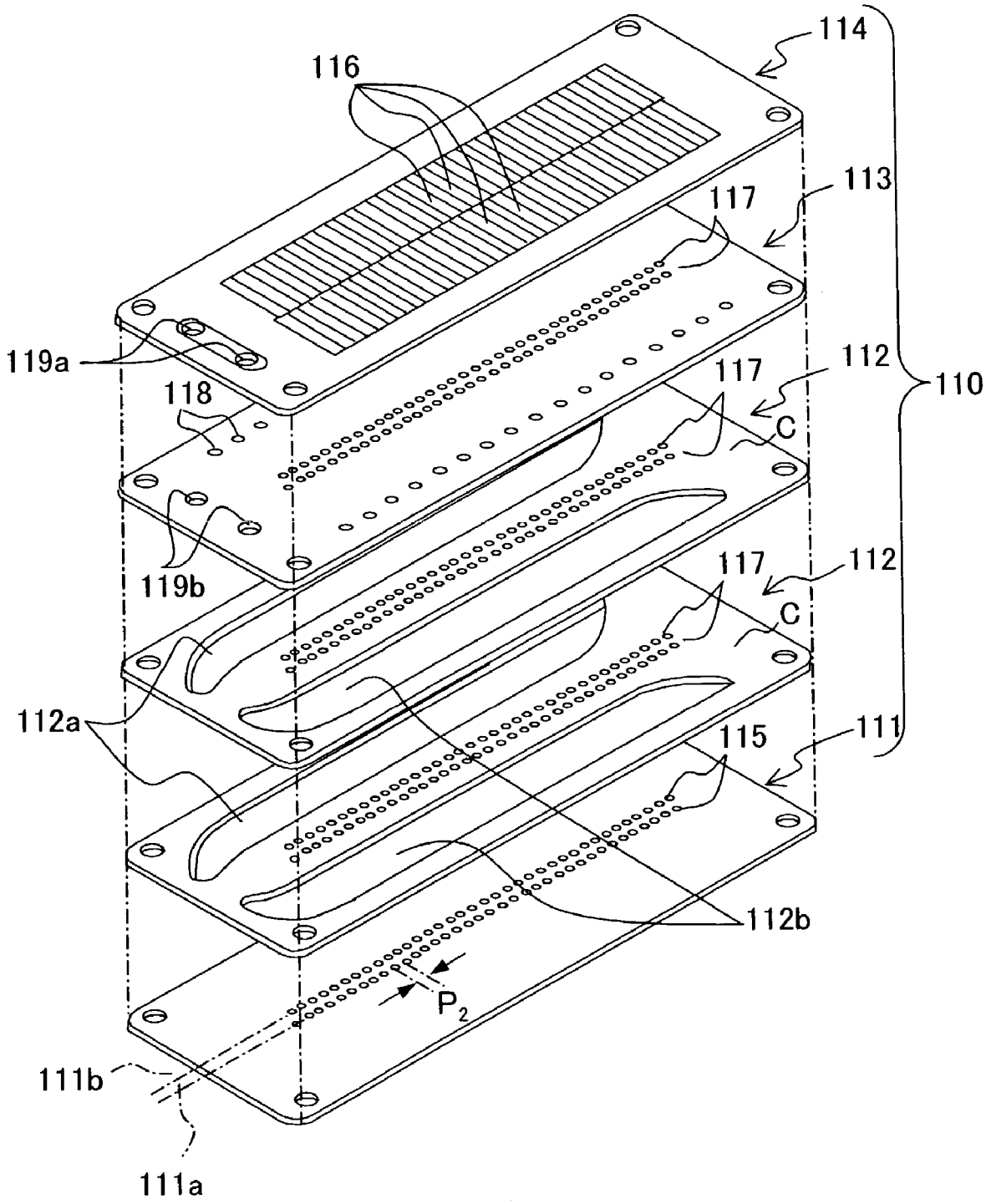
FIG. 20 shows an exploded perspective view illustrating a cavity plate 110.
Figure 21:
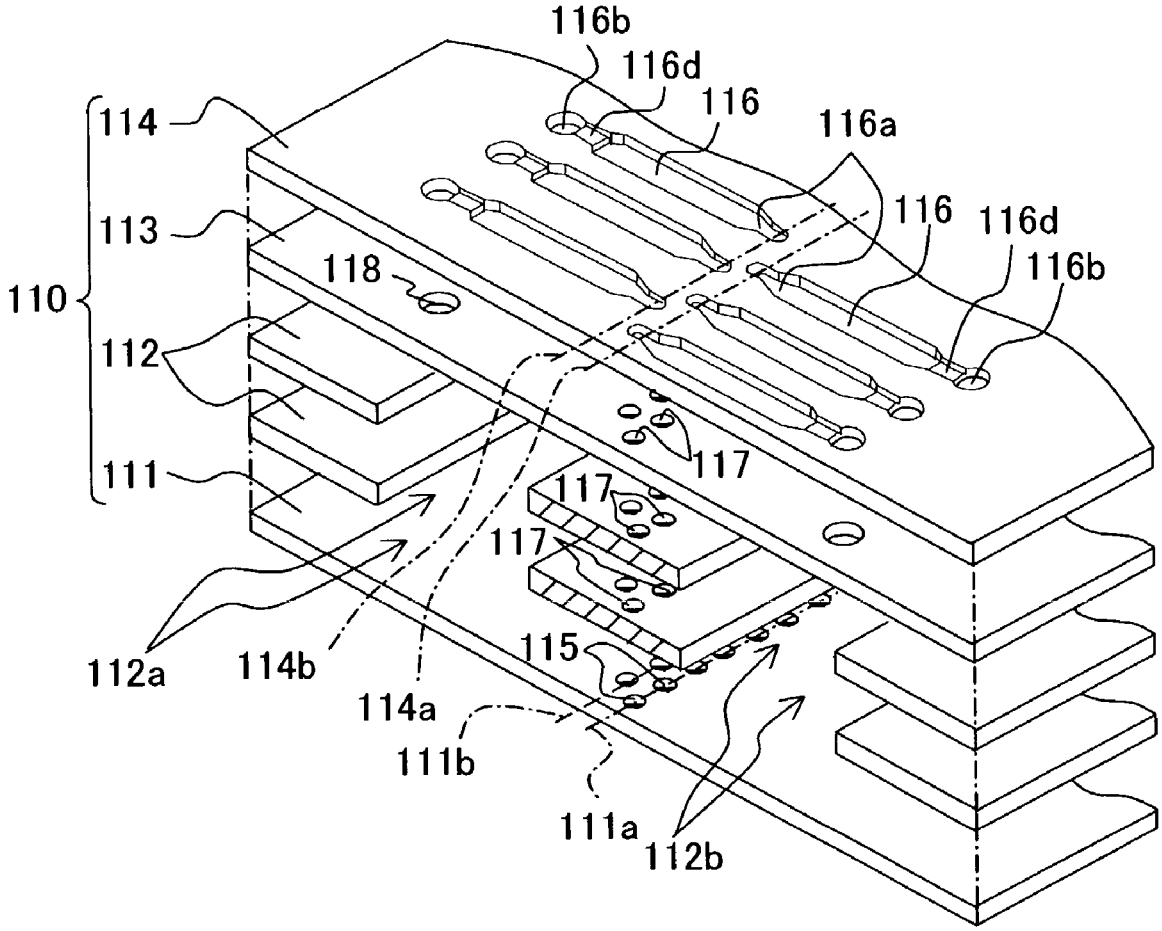
FIG. 21 shows an exploded perspective view illustrating magnified main components of the cavity plate 110.
Figure 22:
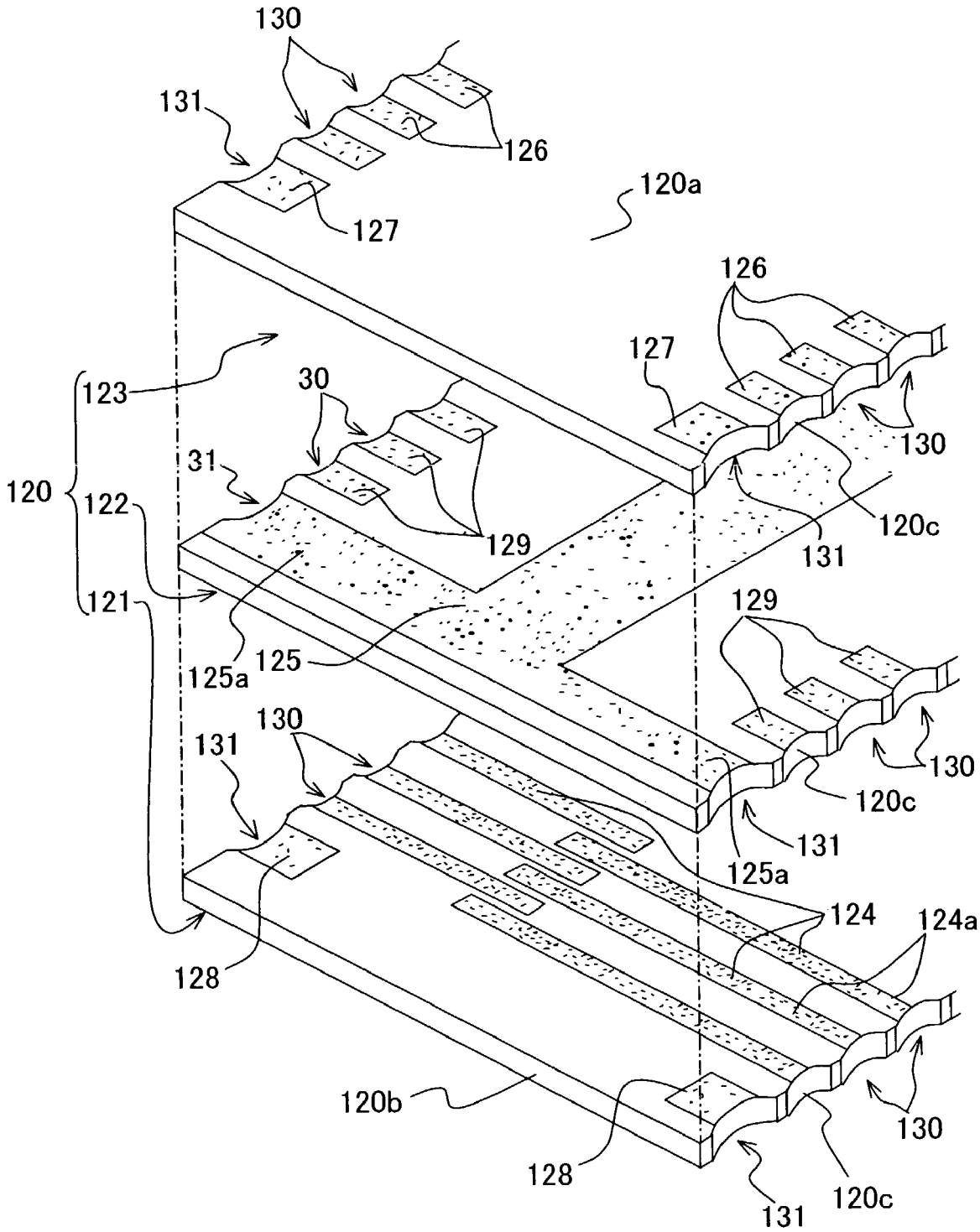
FIG. 22 shows an exploded perspective view illustrating magnified main components of a piezoelectric actuator 120.

At first, the structure of a piezoelectric ink-jet head 106 will be explained with reference to FIGS. 18 to 22. FIG. 18 shows an exploded perspective view illustrating the piezoelectric ink-jet head 106. FIG. 19 shows a side sectional view illustrating the piezoelectric ink-jet head 106. FIG. 20 shows an exploded perspective view illustrating a cavity plate 110. FIG. 21 shows an exploded perspective view illustrating magnified main components of the cavity plate 110. FIG. 22 shows an exploded perspective view illustrating magnified main components of a piezoelectric actuator 120.

As shown in FIGS. 18 and 19, the piezoelectric ink-jet head 106 is constructed by laminating and joining, with an adhesive, the stacked type cavity plate 110 which is composed of a plurality of sheets, the plate type piezoelectric actuator 120 which is adhered and stacked onto the cavity plate 110 by the aid of the adhesive or an adhesive sheet with a vibration plate 129*a* intervening therebetween, and a flexible flat cable 140 which is disposed on the upper surface of the piezoelectric actuator 120 in order to effect electric connection to an external apparatus. The ink is jetted downwardly from nozzles 115 which are open on the lower surface side of the cavity plate 110 disposed at the lowermost layer.

On the other hand, as shown in FIG. 20, the cavity plate 110 has such a structure that five thin metal plates, i.e., a nozzle plate 111, two manifold plates 112, a spacer plate 113, and a base plate 114 are superimposed and stacked with an adhesive respectively. In the embodiment of the present invention, each of the plates 111 to 114 is made of 42% nickel alloy steel plate (42 alloy) having a thickness of about 50 μm to 150 μm. Each of the plates 111 to 114 may be formed of, for example, a resin without being limited to the metal.

As shown in FIG. 21, a plurality of pressure chambers 116, each of which has a thin width and which extend in a direction perpendicular to center lines 114*a*, 114*b* in the longitudinal direction, are bored through the base plate 114 in zigzag arrangement. Ink supply holes 116*b* are bored at positions located outwardly from the respective pressure chambers 116 toward the both ends of the base plate 114 in the transverse direction of the base plate 114 respectively corresponding to the respective pressure chambers 116. The respective pressure chambers 116 and the respective ink supply holes 116*b* are connected to one another by throttle sections 116*d* which are formed therebetween. The respective ink supply holes 116*b* are communicated with common ink chambers 112*a*, 112*b* of the manifold plates 112 via respective ink supply holes 118 which are bored through left and right portions on the both sides in the transverse direction of the spacer plate 113. In this structure, the cross-sectional area of each of the throttle sections 116*d* in the direction perpendicular to the direction in which the ink flows is smaller than the cross-sectional area of each of the pressure chambers 116 in the same direction, for the following reason. That is, it is intended to increase the flow passage resistance to the counterflow of the ink toward the ink supply hole 116*b* during the jetting operation. First ends 116*a* of the respective pressure chambers 116 are communicated with the nozzles 115 disposed in the zigzag arrangement in the nozzle plate 111, via through-holes 117 each having a minute diameter bored in the zigzag arrangement as well through the spacer plate 113 and the two manifold plates 112.

As shown in FIG. 20, the ink supply holes 119*a*, 119*b*, which are provided to supply the inks from the ink cartridges (61) to the common ink chambers 112*a*, 112*b* of the manifold plates 112, are bored through the base plate 114 and the spacer plate 113 respectively. The two manifold plates 112 are provided with the two common ink chambers 112*a*, 112*b* which extend in the longitudinal direction while interposing the arrays of the plurality of nozzles 115 of the nozzle plate 111. The common ink chambers 112*a*, 112*b* are formed as openings which penetrate through the respective manifold plates 112. One common ink chamber is formed by the openings which are superimposed in the vertical direction. One common ink chamber 112*a* is communicated with the pressure chambers disposed in one array, and the other common ink chamber 112*b* is communicated with the pressure chambers disposed in the other array (see FIG. 21). The common ink chambers 112*a*, 112*b* are positioned in the plane parallel to the plane formed by the plurality of pressure chambers 116 of the base plate 114. Further, the common ink chambers 112*a*, 112*b* are formed to extend by longer distances in the direction of the arrays formed by the plurality of nozzles 115 on the side of the opening surface of the plurality of nozzles 115 of the nozzle plate 111 as compared with the plurality of pressure chambers 116.

The common ink chambers 112*a*, 112*b* are shaped such that the cross-sectional areas are decreased at certain proportions in directions to make separation from the ink supply holes 119*a*, 119*b* at the ends (C portions) separated from the ink supply holes 119*a*, 119*b*, for the following reason. That is, it is intended to facilitate the discharge of remaining bubbles which are apt to stay at the ends (C portions) of the common ink chambers 112*a*, 112*b*. The common ink chambers 112*a*, 112*b* are structured such that they are tightly closed by stacking the nozzle plate 111 and the spacer plate 113 on the two manifold plates 112.

The plurality of nozzles 115 for jetting the inks, each of which has a minute diameter (about 25 μm in this embodiment), are bored through the nozzle plate 111 in the zigzag arrangement at spacing distances of minute pitches $P_2$ along center lines 111*a*, 111*b* in the longitudinal direction of the nozzle plate 111. The respective nozzles 115 correspond to respective through-holes 117 bored through the manifold plates 112.

The cavity plate 110 is constructed as described above. Accordingly, the ink, which inflows into each of the common ink chambers 112*a*, 112*b* from the ink cartridge (61) via each of the ink supply holes 119*a*, 119*b* bored at the first ends of the base plate 114 and the spacer plate 113, passes from each of the common ink chambers 112*a*, 112*b* through the respective ink supply holes 118, the respective ink supply holes 116*b*, and the throttle sections 116*d*, and the ink is distributed to the respective pressure chambers 116. The ink flows in the direction toward the first ends 116*a* of the respective pressure chambers 116. The ink passes through the respective through-holes 117, and arrives at the nozzles 115 corresponding to the respective pressure chambers 116.

On the other hand, as shown in FIG. 22, the piezoelectric actuator 120 is structured such that two piezoelectric sheets 121, 122 and one insulating sheet 123 are stacked. A plurality of driving electrodes 124, each of which has a thin width and which correspond to the respective pressure chamber 116 of the cavity plate 110 one by one, are provided in the zigzag arrangement on the upper surface of the piezoelectric sheet 121 disposed at the lowermost level. First ends 124*a* of the respective driving electrodes 124 are formed to be exposed to left and right side surfaces 120*c* which are perpendicular to front and back surfaces 120*a*, 120*b* of the piezoelectric actuator 120.

A common electrode 125, which is common to the plurality of pressure chambers 116, is provided on the upper surface of the piezoelectric sheet 122 disposed at the next level. First ends 125*a* of the common electrode 125 are also formed to be exposed to the left and right side surfaces 120*c* in the same manner as the first ends 124*a* of the respective driving electrodes 124. Respective regions of the piezoelectric sheet 122, which are interposed between the respective driving electrodes 124 and the common electrode 125, serve as pressure-generating sections 128*a* corresponding to the respective pressure chambers 116 one by one. The pressure-generating sections 128*a* are subjected to the polarization treatment in a direction P directed from the driving electrodes 124 to the common electrode 125. This embodiment is constructed such that the area occupied by the pressure-generating sections 128*a* is about 10% of the area occupied by the pressure chambers 116.

Surface electrodes 126 corresponding to the respective driving electrodes 124 one by one and surface electrodes 127 corresponding to the common electrode 125 are provided on the upper surface of the insulating sheet 123 disposed at the uppermost level so that the surface electrodes 126, 127 are aligned along the left and right side surfaces

120*c*. First recessed grooves 130 are provided for the first ends 124*a* of the respective driving electrodes 124 and second recesses grooves 131 are provided for the first ends 125*a* of the common electrode 125 so that the first and second recessed grooves 130, 131 extend in the stacking direction on the left and right side surfaces 120*c* respectively. As shown in FIG. 19, a side surface electrode 132, which electrically connects each of the driving electrodes 124 and each of the surface electrodes 126, is formed in each of the first recessed grooves 130. Further, a side surface electrode 133, which electrically connects the common electrode 125 and each of the surface electrodes 127, is formed in each of the second recessed grooves 131. Electrodes designated by reference numerals 128 and 129 are electrodes of extra patterns.

Figure 23:
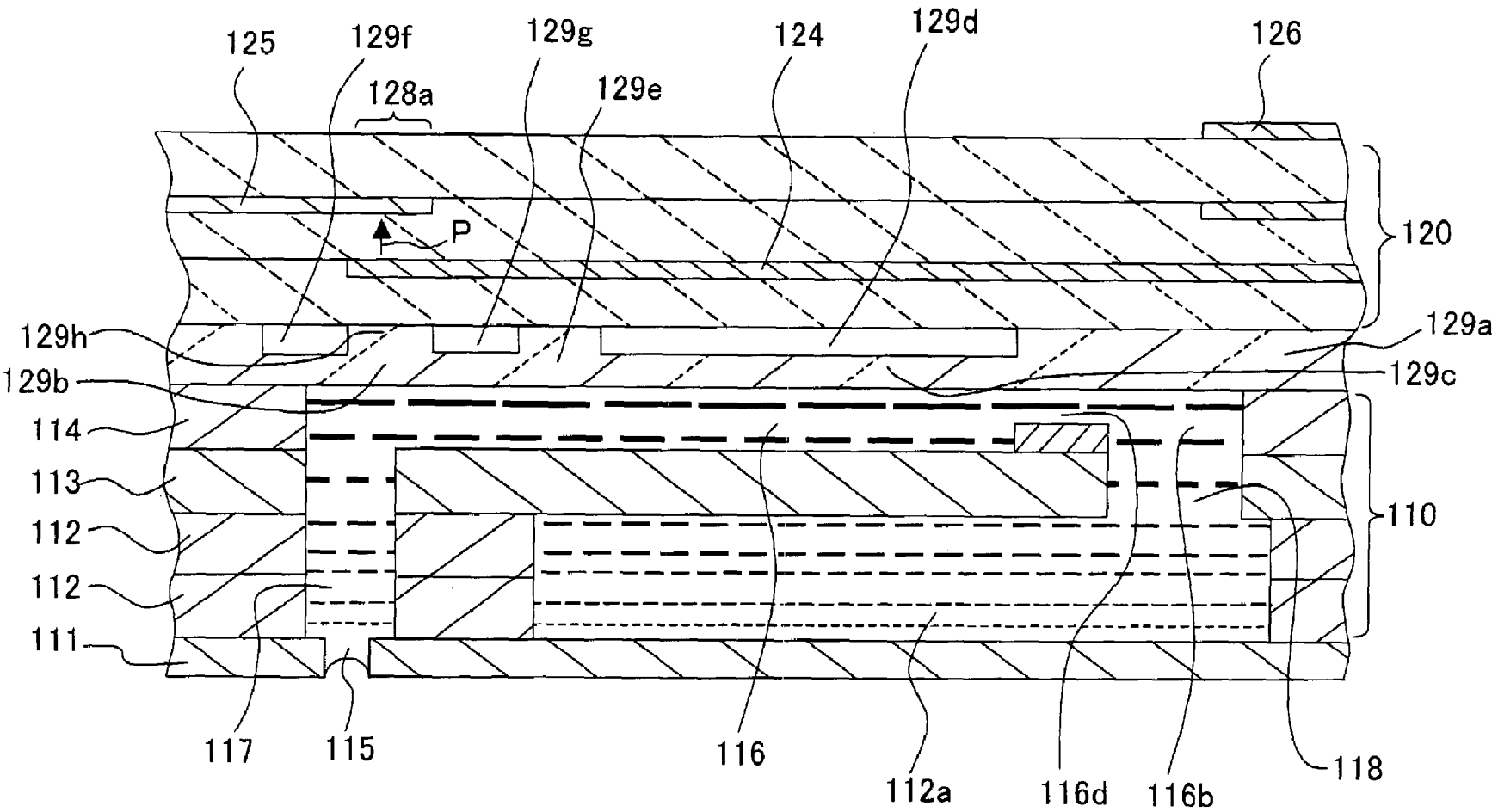
FIG. 23 shows a magnified sectional view illustrating the piezoelectric ink-jet head 106 shown in FIG. 19.

On the other hand, FIG. 23 shows a magnified sectional view illustrating the piezoelectric ink-jet head 106 shown in FIG. 19. FIG. 23 shows a state in which the common ink chamber 112*a* and the pressure chamber 116 are filled with the ink. As shown in FIG. 23, the vibration plate 129*a* is arranged between the piezoelectric actuator 120 and the cavity plate 110. The vibration plate 129*a* has three space sections 129*d*, 129*f*, 129*g* which are formed as recesses by means of, for example, the half etching so that the space sections 129*d*, 129*f*, 129*g* are aligned in the longitudinal direction of the pressure chamber 116 on the side to make contact with the piezoelectric actuator 120. A projection 129*e*, which is disposed between the space sections 129*g*, 129*d*, is secured to the piezoelectric actuator 120 while making abutment thereagainst. The projection 129*e* serves as a support point section when the vibration plate 129*a* is displaced as described later on. A portion of the vibration plate 129*a*, which corresponds to a region ranging from the space section 129*g* disposed on one side of the projection 129*e* to the space section 129*f*, serves as a first deformable section 129*b*. A portion of the vibration plate 129*a*, which is interposed between the pressure chamber 116 and the space section 129*d* disposed on the other side of the projection 129*e*, serves as a second deformable section 129*c*. The first deformable section 129*b* is opposed to the pressure-generating section 128*a* of the piezoelectric actuator 120 via a projection 129*h* intervening therebetween. The first deformable section 129*b* and the second deformable section 129*c* are positioned corresponding to the pressure chamber 116. The tip of the second deformable section 129*c* does not arrive at the throttle section 116*d*. The length of the first deformable section 129*b* in the longitudinal direction of the pressure chamber 116 is shorter than the length of the second deformable section 129*c* in the longitudinal direction of the pressure chamber 116. It is enough that the respective space sections 129*d*, 129*f*, 129*g* are formed to successfully secure the first deformable section 129*b*, the second deformable section 129*c*, and the projection 129*e*. They may be formed by arranging and stacking a bored plate on the piezoelectric actuator 120 and a non-bored plate on the side of the pressure chamber 116, without being limited to the half etching.

The size of the main components constructing the piezoelectric actuator of the present embodiment is indicated as below.

Figure 24:
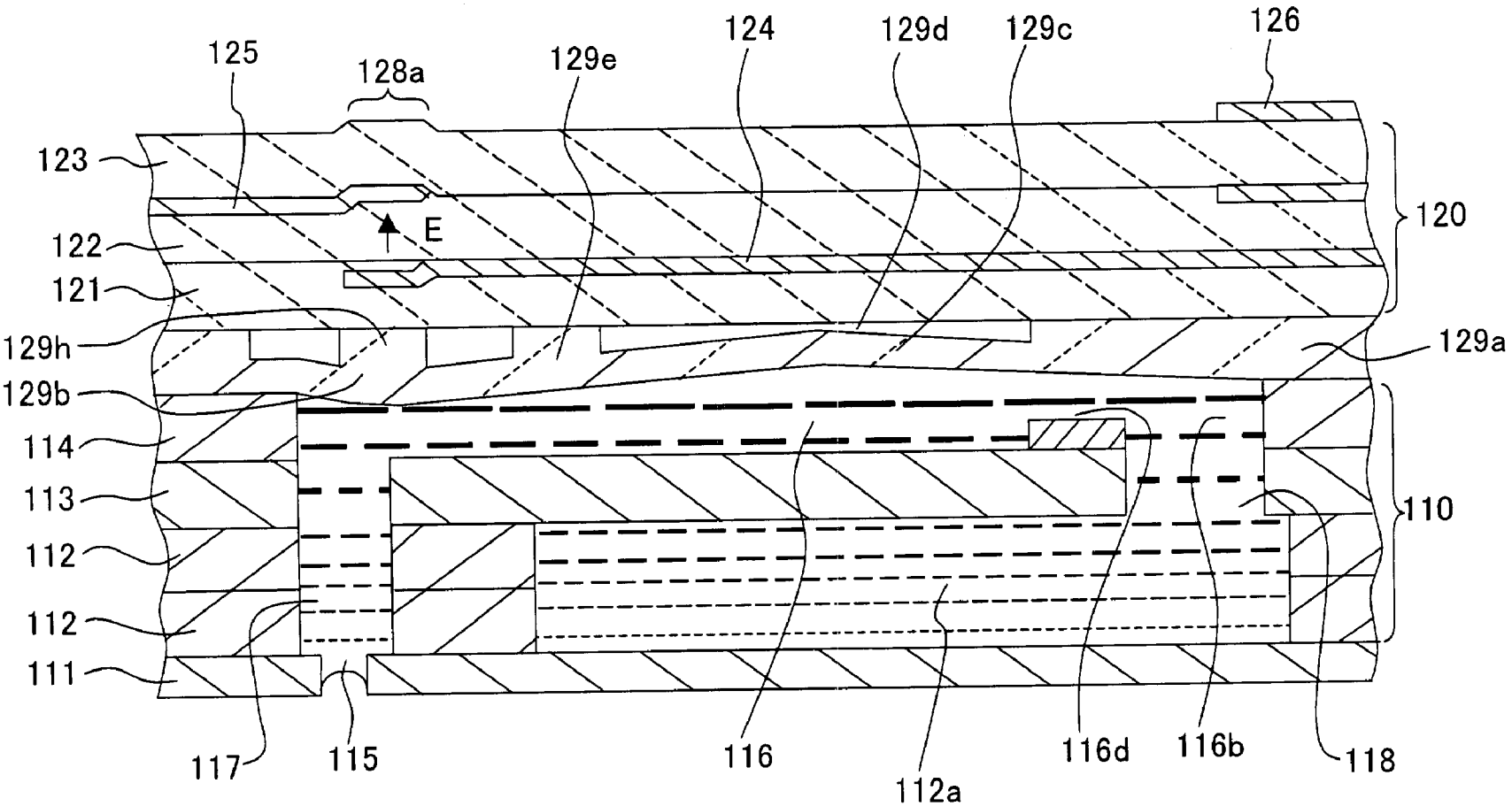
FIG. 24 shows a magnified sectional view illustrating the operation of the piezoelectric ink-jet head 106.
Figure 25:
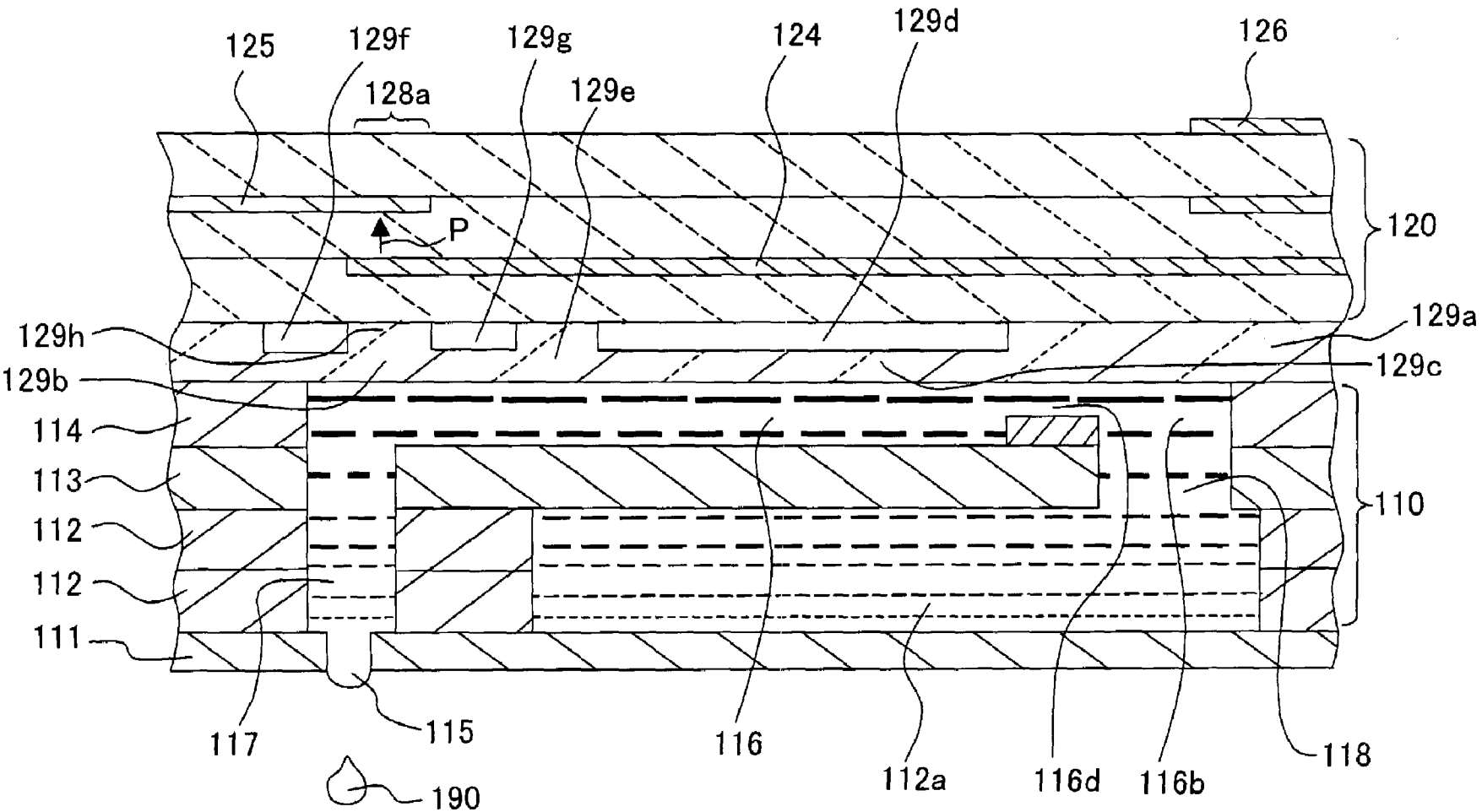
FIG. 25 shows a magnified sectional view illustrating a situation in which ink droplets are jetted by the piezoelectric ink-jet head 106.

Length of the pressure chamber 116 (in the direction perpendicular to 114*a*): 3.7 mm Width of the pressure chamber 116 (in the direction parallel to 114*a*): 0.13 mm Depth of the pressure chamber 16 (the thickness of the base plate 114): 0.05 mm Width of the driving electrode 124: 0.1 mm Thickness of the piezoelectric sheets 121, 122: 0.03 mm Diameter of the nozzle 115: 0.025 mm Next, the operation of the ink-jet printer (100) during the printing will be explained with reference to FIGS. 24 and 25. As shown in FIG. 24, when a positive voltage is applied to an arbitrary driving electrode 124 of the respective driving electrodes 124 of the piezoelectric actuator 120 of the piezoelectric ink-jet head 106, and the common electrode 125 is connected to the ground, then the electric field E is generated between the electrodes in the direction which is coincides with the direction of polarization P. The portion of the piezoelectric sheet 122 corresponding to the driving electrode 124 to which the voltage is applied, i.e., the pressure-generating section 128*a* is elongated in the stacking direction owing to the piezoelectric vertical effect. The pressure-generating section 128*a* is elongated by $20\times10^{-6}$ mm in the stacking direction.

The elongation causes the pushing action on the projection 129*h* so that the first deformable section 129*b* of the vibration plate 129*a* is deformed toward the pressure chamber 116. Accordingly, the second deformable section 129*c* of the vibration plate 129*a* is deformed about the support point of the projection 129*e* in the opposite direction, i.e., into the space section 129*d* on the side of the piezoelectric actuator 120, and thus the volume of the pressure chamber 116 is expanded. In this arrangement, the length of the first deformable section 129*b* in the longitudinal direction of the pressure chamber 116 is shorter than the length of the second deformable section 129*c* in the longitudinal direction of the pressure chamber 116. Therefore, the amount of increase of the volume of the pressure chamber 116 brought about by the second deformable section 129*c* is much larger than the amount of decrease of the volume on the side of the pressure chamber 116 brought about by the first deformable section 129*b* in accordance with the lever principle. As a result, the volume of the pressure chamber 116 corresponding to each of the driving electrodes 124 is greatly expanded, and the pressure in the pressure chamber 116 is decreased. It was found out that by the displacement of the first deformable portion 129*b*, the volume of the pressure chamber 116 was decreased by $3.7\times10^{-6}$ $mm^3$, and by the displacement of the second deformable portion 129*c*, the volume of the pressure chamber 116 is increased by $10.2\times10^{-6}$ $mm^3$. Further, in the piezoelectric actuator of the conventional structure as shown in FIG. 28, when the pressure-generating section 228*a* had the same area as that of the pressure-generating section 128*a* shown in FIG. 23, the volume of the pressure chamber was decreased by $0.851\times10^{-6}$ $mm^3$ by the elongation of the pressure-generating section 228*a* in the stacking direction. Namely, owing to the provision of the first and the second deformable sections, the piezoelectric actuator of the present invention has realized a pull-eject in which the change of volume is relatively large.

The state, in which the volume of the pressure chamber 116 is expanded, is maintained by a period of one-way transmission time T of the generated pressure wave in the pressure chamber 116. By doing so, the ink, which corresponds to the increased volume of the pressure chamber 116, is supplied during the period of time from the common ink chamber 112*a* via the ink supply hole 118, the ink supply hole 116, and the throttle section 116*d*.

The one-way transmission time T is the time which is necessary for the pressure wave in the pressure chamber 116 to be transmitted in the longitudinal direction of the pressure chamber 116 (in the lateral direction on the plane of the drawing paper). The one-way transmission time T is determined as T=L/a by the length L of the pressure chamber 116 and the acoustic velocity "a" in the ink in the pressure chamber 116. According to the pressure wave transmission theory, when an approximate period of time T elapses from the application of the voltage, then the pressure in the pressure chamber 116 is inverted, and the pressure is changed to the positive pressure. When the application of the voltage to the driving electrode 124 is stopped in conformity with this timing, then the pressure-generating section 128*a* is restored to the original state as shown in FIG. 25, and the volume of the pressure chamber 116 is restored to the original volume by the second deformable section 129*c*. Therefore, the pressure is applied to the ink contained in the pressure chamber 116. In this situation, the pressure having been changed to the positive and the pressure generated by the restoration of the second deformable section 129*c* are added to one another, and a relatively high pressure is generated at a portion in the vicinity of the nozzle 115 communicating with the pressure chamber 116. Accordingly, the ink droplets 190 are jetted from the nozzle 115 efficiently as compared with the simple push-eject.

As explained above, in the piezoelectric ink-jet head 106 according to the embodiment of the present invention, the vibration plate 129*a* has the first deformable section 129*b* which is deformable toward the pressure chamber 116 and the second deformable section 129*c* which is deformable into the space section 129*d* disposed on the side opposite to the pressure chamber 116 in accordance with the displacement of the first deformable section 129*b*, the first deformable section 129*b* and the second deformable section 129*c* being aligned in the longitudinal direction of the pressure chamber 116 with the projection 129*e* as the support point section intervening therebetween. The first deformable section 129*b* is opposed to the pressure-generating section 128*a* which is elongatable and displaceable in accordance with the application of the voltage. Therefore, when the voltage is applied, the elongation of the pressure-generating section 128*a* deforms the first deformable section 129*b* toward the pressure chamber 116 to decrease the volume of the pressure chamber 116. However, the second deformable section 129*c* is displaced into the space section 129*d* about the support point of the projection 129*e* to increase the volume of the pressure chamber 116. Therefore, the pull-eject, which is advantageous to achieve the high driving frequency and perform the large volume jetting operation, can be easily accomplished by applying the voltage during the jetting operation. The length of the first deformable section 129*b* in the longitudinal direction of the pressure chamber 116 is shorter than the length of the second deformable section 129*c* in the longitudinal direction of the pressure chamber 116. Therefore, the amount of expansion of the volume of the pressure chamber 116 brought about by the second deformable section 129*c* is larger than the amount of decrease of the volume on the side of the pressure chamber 116 brought about by the first deformable section 129*b* in accordance with the lever principle. Accordingly, it is possible to decrease the area of the pressure-generating section 128*a* necessary to obtain the desired volume change in the pressure chamber 116. It is possible to reduce the electrostatic capacity possessed by the pressure-generating section 128*a*, and it is possible to perform the driving operation at a lower voltage. Further, in the embodiment of the present invention, the space sections 129*f*, 129*g*, 129*d* are provided, for example, by means of the half etching so that the projection 129*e* is formed therebetween. The support point section is formed without using any special member, and the effect of the present invention is realized without complicating the structure.

In the second embodiment, by making the area of the pressure-generating section to be not more than 60% of the area of the pressure chamber, it is possible to increase the volume change of the pressure chamber to obtain a sufficient ink-eject amount. The area of the pressure-generating section means an area of the pressure-generating section interposed between the driving electrode 124 and the common electrode 125 in the piezoelectric actuator 120. The area of the pressure chamber is an area of the pressure chamber 116 except the both ends (the first ends 116*a*, the throttle sections 116*d*, the ink supply holes 116*b*), and means an area of the wall surface which defines the pressure chamber and which is displaceable in a direction to vary a volume of the pressure chamber 116.

Figure 26:
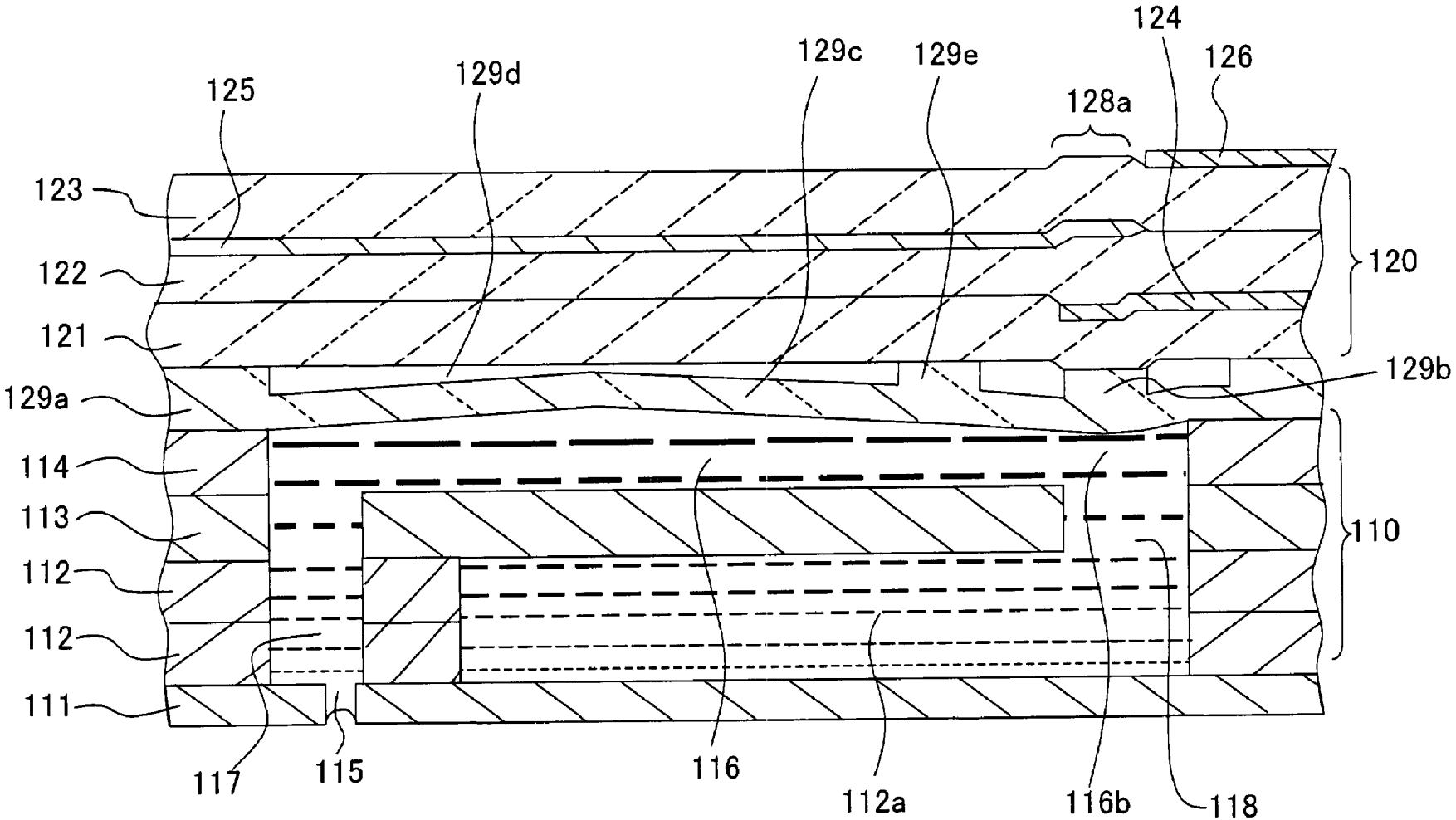
FIG. 26 shows a magnified sectional view illustrating the operation of a piezoelectric ink-jet head according to another embodiment.

FIG. 26 shows a magnified sectional view illustrating the operation of a piezoelectric ink-jet head according to another embodiment. As shown in FIG. 26, as for the positional relationship between the first deformable section and the second deformable section, the first deformable section 129*b* may be arranged on the side of the ink supply hole 118 to supply the ink to the pressure chamber 116. In the same manner as in the embodiment described above, as shown in FIG. 26, when the voltage is applied, the elongation in the stacking direction is generated in the pressure-generating section 128*a* in accordance with the piezoelectric vertical effect. The elongation deforms the first deformable section 129*b* of the vibration plate 129*a* toward the pressure chamber 116 to decrease the volume of the pressure chamber 116. Accordingly, the second deformable section 129*c* is deformed into the space section 129*d* about the support point of the projection 129*e* to expand the volume of the pressure chamber 116.

Figure 27:
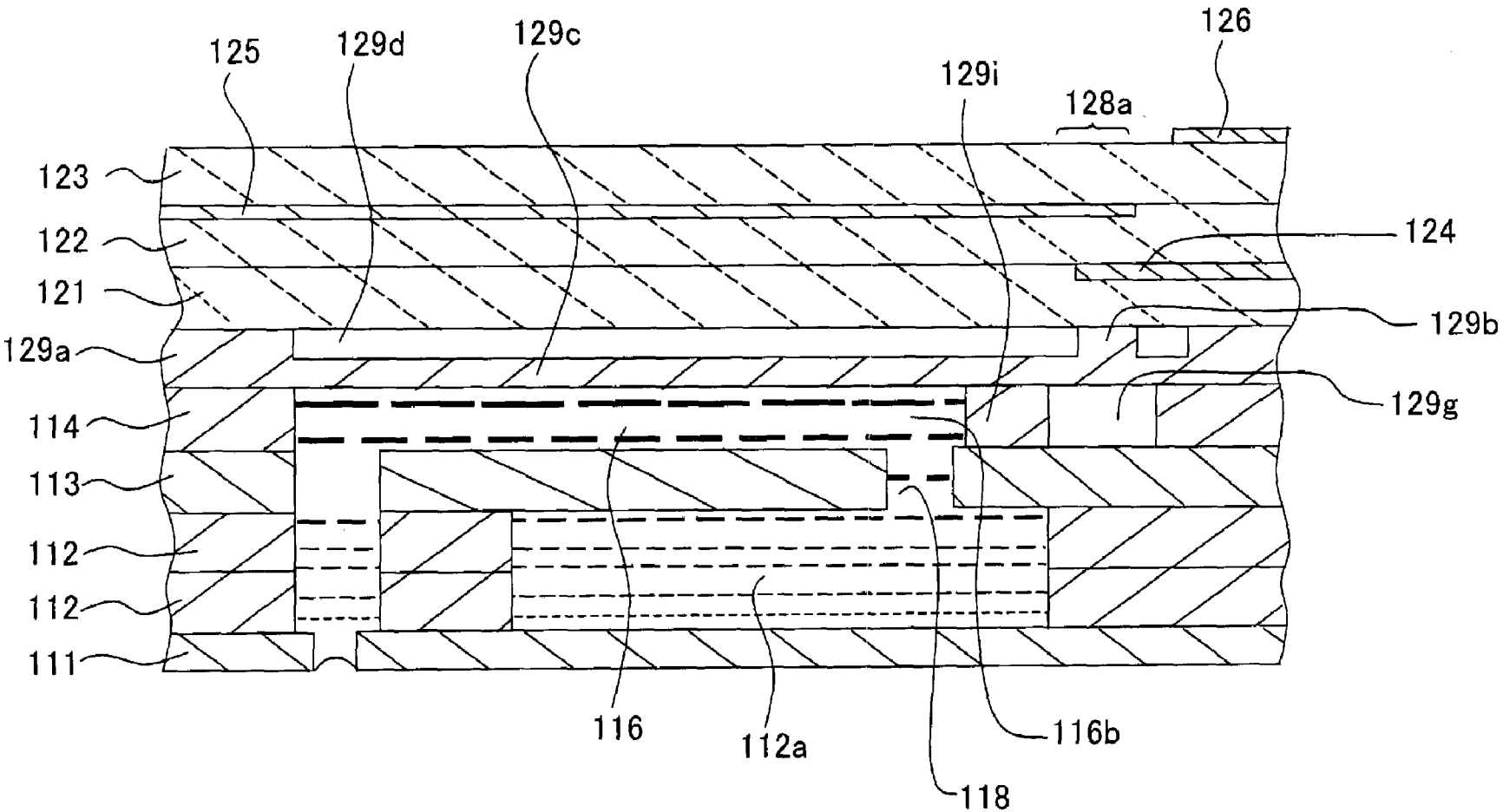
FIG. 27 shows a magnified sectional view illustrating a piezoelectric ink-jet head according to still another embodiment.

FIG. 27 shows a magnified sectional view illustrating a piezoelectric ink-jet head according to still another embodiment. In this embodiment, the first deformable section 129*b* is not deformed into the pressure chamber 116. A space section 129*g* is provided at a portion opposed to the first deformable section 129*b* disposed outside the pressure chamber 116. The vibration plate 129*a* is provided with no support point section. A support point section 129*i* is provided between the pressure chamber 116 and the space section 129*g*. The space section 129*g* and the support point section 129*i* are formed in an aligned manner with the pressure chamber 116 in the base plate 114. When the voltage is applied, the elongation in the stacking direction is generated in the pressure-generating section 128*a* in accordance with the piezoelectric vertical effect. The elongation deforms the first deformable section 129*b* into the space section 129*g*. The volume of the pressure chamber 116 is not decreased at all, because the space section 129*g* is disposed outside the pressure chamber 116. The second deformable section 129*c* is deformed into the space section 129*d* about the support point of the support point section 129*i*. The volume of the pressure chamber 116 is increased in an amount of the total volume corresponding to the deformation of the second deformable section 129*c*. Therefore, it is possible to expand the volume of the pressure chamber 116 more efficiently.

The present invention has been explained with reference to the specified embodiments described above. However, the present invention is not limited to the specified embodiments. It is possible to make a variety of improvements and modifications of the specified embodiments within a range in which the present invention is not deviated from the gist or essential characteristics thereof. That is, it is possible to apply an arbitrary structure provided that the pressure chamber is expanded by the elongation of the pressure-generating section toward the pressure chamber in the structure.

The first object is to provide the droplet-jetting device in which the electrostatic capacity is suppressed to improve the energy efficiency and the voltage is applied only when the device is driven so that the pull-eject is successfully performed as in the droplet-jetting device of the present invention. The second object of the present invention is to provide the droplet-jetting device which makes it possible to increase the driving frequency and which makes it possible to increase the volume of the liquid droplet.

What is claimed is:

1. A droplet-jetting device comprising a nozzle which jets a liquid, a pressure chamber which supplies the liquid to the nozzle, and a pressure-generating section which applies a pressure to the pressure chamber in order to jet the liquid from the nozzle, wherein:

the pressure chamber is defined by a plurality of opposing surfaces;

a wall surface, which defines one of the opposing surfaces of the pressure chamber which is furthest from the pressure-generating section, is displaceable to vary a volume of the pressure chamber; and the droplet-jetting device further comprises a connecting section which connects the pressure-generating section to the wall surface to transmit displacement of the pressure-generating section to the wall surface.

2. The droplet-jetting device according to claim 1, wherein when the pressure-generating section is displaced, while the displacement of the connecting section does not directly change the volume of the pressure chamber, the wall surface increases the volume of the pressure chamber.

3. The droplet-jetting device according to claim 1, wherein an area of the pressure-generating section is smaller than about 60% of an area of the wall surface of the pressure chamber.

4. The droplet-jetting device according to claim 1, further comprising an actuator unit which covers a surface opposed to the wall surface of the pressure chamber and which includes the pressure-generating section, wherein the pressure-generating section is displaced in an area which is smaller than the wall surface of the pressure chamber.

5. The droplet-jetting device according to claim 4, wherein the wall surface of the pressure chamber has one end which is disposed in a longitudinal direction of the pressure chamber and which serves as a support point, and the other end which is displaceable about the support point to vary the volume of the pressure chamber.

6. The droplet-jetting device according to claim 5, wherein an area of the actuator unit to be displaced by the pressure-generating section is about 5% to 40% of an area of the wall surface of the pressure chamber.

7. The droplet-jetting device according to claim 5, wherein the pressure chamber includes a plurality of chambers which are arranged in array, a common liquid chamber is provided to distribute the liquid to the respective chambers, the common liquid chamber extends in a direction of the array of the respective chambers on a side opposite to the respective chambers with wall sections for constituting the wall surfaces of the respective chambers intervening therebetween, and each of the wall sections for constituting the wall surfaces is displaceable toward the common liquid chamber by the displacement of the pressure-generating section.

8. The droplet-jetting device according to claim 7, further comprising a first plate which has first openings corresponding to the respective chambers formed penetratingly in a plate thickness direction, a second plate which has a second opening corresponding to the common liquid chamber formed penetratingly in the plate thickness direction, and a third plate which has the wall sections disposed between the respective chambers and the common liquid chamber, wherein the third plate is positioned between the first and second plates.

9. The droplet-jetting device according to claim 4, wherein the pressure chamber has one end which is disposed in a longitudinal direction and which is communicated with the nozzle, and the other end which is communicated with an ink supply source via a throttle section having a cross section smaller than that of the pressure chamber, and the connecting section is composed of a wall portion which defines the throttle section.

10. The droplet-jetting device according to claim 4, wherein the pressure-generating section includes a piezoelectric material and electrodes which are positioned opposingly in a direction of polarization thereof, and the piezoelectric material is elongatable by application of a voltage to the electrodes.

11. The droplet-jetting device according to claim 4, wherein an area of the pressure-generating section is smaller than about 60% of an area of the wall surface of the pressure chamber.

12. An ink-jet recording apparatus comprising the droplet-jetting device as defined in claim 1.

13. The droplet-jetting device according to claim 1, wherein when the pressure-generating section is displaced, a volumetric change of the pressure chamber caused by displacement of the wall surface is greater than a volumetric change of the pressure chamber caused directly by displacement of the pressure-generating section.

* * * * *